US007006959B1

(12) United States Patent
Huh et al.

(10) Patent No.: US 7,006,959 B1
(45) Date of Patent: Feb. 28, 2006

(54) METHOD AND SYSTEM FOR SIMULATING A HYDROCARBON-BEARING FORMATION

(75) Inventors: Chun Huh, Houston, TX (US); Gary F. Teletzke, Sugar Land, TX (US); Sriram S. Nivarthi, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 996 days.

(21) Appl. No.: 09/675,908

(22) Filed: Sep. 29, 2000

Related U.S. Application Data

(60) Provisional application No. 60/159,035, filed on Oct. 12, 1999.

(51) Int. Cl.
*G06G 7/48* (2006.01)

(52) U.S. Cl. ..... 703/10; 166/252.2; 166/252.3; 166/252.4

(58) Field of Classification Search ..... 703/10; 166/252.2, 252.3, 252.4
See application file for complete search history.

(56) References Cited

U.S. PATENT DOCUMENTS

| | | | | |
|---|---|---|---|---|
| 3,017,934 A | | 1/1962 | Rhodes et al. | 175/7 |
| 3,667,240 A | | 6/1972 | Vilain | 61/46.5 |
| 3,720,066 A | | 3/1973 | Vilain | 61/46.5 |
| 3,785,437 A | | 1/1974 | Clampitt et al. | 166/281 |
| 3,858,401 A | | 1/1975 | Watkins | 61/46 |
| 3,992,889 A | | 11/1976 | Watkins et al. | 61/86 |
| 4,099,560 A | | 7/1978 | Fischer et al. | 166/0.5 |
| 4,176,986 A | | 12/1979 | Taft et al. | 405/211 |
| 4,422,801 A | | 12/1983 | Hale et al. | 405/195 |
| 4,467,868 A | | 8/1984 | Adamache | 166/263 |
| 4,646,840 A | | 3/1987 | Bartholomew et al. | 166/350 |
| 4,715,444 A | | 12/1987 | Mac Allister et al. | 166/269 |
| 4,860,828 A | * | 8/1989 | Oswald et al. | 166/403 |
| 5,076,357 A | | 12/1991 | Marquis | 166/273 |
| 5,632,336 A | | 5/1997 | Notz et al. | 166/402 |
| 5,706,897 A | | 1/1998 | Horton, III | 166/359 |
| 5,711,373 A | | 1/1998 | Lange | 166/252.2 |
| 6,152,226 A | * | 11/2000 | Talwani et al. | 166/252.4 |

FOREIGN PATENT DOCUMENTS

GB 1519203 7/1978

OTHER PUBLICATIONS

Mary F. Wheeler, Todd Arbogast, Steven Bryant, Joe Eaton, Qin Liu, Malgorzata Peszynska; "A Parellel Multiblock/Multidomain Approach for Reservoir Simulation"; Reservoir Simulation Symposium; Feb. 14-17, 1999.*

(Continued)

*Primary Examiner*—Jean R. Homere
*Assistant Examiner*—Herng-der Day

(57) ABSTRACT

The invention is a method for simulating one or more characteristics of a multi-component, hydrocarbon-bearing formation into which a displacement fluid having at least one component is injected to displace formation hydrocarbons. The first step of the method is to equate at least part of the formation to a multiplicity of gridcells. Each gridcell is then divided into two regions, a first region representing a portion of each gridcell swept by the displacement fluid and a second region representing a portion of each gridcell essentially unswept by the displacement fluid. The distribution of components in each region is assumed to be essentially uniform. A model is constructed that is representative of fluid properties within each region, fluid flow between gridcells using principles of percolation theory, and component transport between the regions. The model is then used in a simulator to simulate one or more characteristics of the formation.

18 Claims, 9 Drawing Sheets

OTHER PUBLICATIONS

Meakin et al., "Simulations of One- and Two-Phase Flow in Fractures", Nov. 1996, pp. 1-18.*
King et al., "Predicting Oil Recovery Using Percolation", Physica A 266, Apr. 1999, pp. 107-114.*
F. John Fayers and Trevor M. J. Newley, *Detailed Validation of an Empirical Model for Viscous Fingering With Gravity Effects*, SPE Reservoir Engineering, May 1988, pp. 542-550.
J. W. Gardner, F. M. Orr and P. D. Patel, *The Effect of Phase Behavior on $CO_2$-Flood Displacement Efficiency*, Journal of Petroleum Technology, Nov. 1981, pp. 2067-2081.
Z. E. Heinemann, C. W. Brand, Margit Munka and Y. M. Chen, *Modeling Reservoir Geometry With Irregular Grids*, SPE Reservoir Engineering, May 1991, pp. 225-232.
S. Verma and K. Aziz, *A Control Volume Scheme for Flexible Grids in Reservoir Simulation*, Society of Petroleum Engineers #37999, Jun. 1997, pp. 215-227.
F. J. Fayers and F. Jouaux, *An Improved Macroscopic Model for Viscous Fingering and Its Validation for 2D and 3D Flows III. Inclusion of Effects of Heterogeneities*, Department of Petroleum Engineering—Stanford University, Marcel Dekker, Inc., 1995 pp. 393-425.
J. W. Gardner and J. G. J. Ypma, *An Investigation of Phase-Behavior/Macroscopic-Bypassing Interaction in $CO_2$ Flooding*, SPE Journal, Oct. 1984, pp. 508-520.
L. C. Young, *The Use of Dispersion Relationships To Model Adverse Mobility Ratio Miscible Displacements*, SPE/DOE 14899, Apr. 20-23, 1986, pp. 265-272 (Tables 1-4, Figs. 1-13).
J. G. Crump, *Detailed Simulations of the Effects of Process Parameters on Adverse Mobility Ratio Displacements*, SPE/DOE 17337, Apr. 17-20, 1988, pp. 187-199.
J. W. Barker and F. J. Fayers, *Transport Coefficients for Compositional Simulation With Coarse Grids in Heterogeneous Media*, SPE 22591 Oct. 6-9, 1991, pp. 41-53.
E. J. Koval, *A Method for Predicting the Performance of Unstable Miscible Displacement in Heterogeneous Media*, SPE Journal Jun. 1963, pp. 145-154.
E. L. Dougherty, *Mathematical Model of an Unstable Miscible Displacement*, SPE Journal Jun. 1963, pp. 155-163.
M. R. Todd and W. J. Longstaff, *The Development, Testing, and Application Of a Numerical Simulator for Predicting Miscible Flood Performance*, Journal of Petroleum Technology, Jul. 1972, pp. 874-882.
F. John Fayers, *An Approximate Model With Physically Interpretable Parameters for Representing Miscible Viscous Fingering*, SPE Reservoir Engineering, May 1988, pp. 551-558.
M. R. Todd and C. A. Chase, *Numerical Simulator For Predicting Chemical Flood Performance*, SPE 7689, Feb. 1-2, 1979, pp. 161-170 (Fig. 1-7).
Scott Kirkpatrick, *Percolation and Conduction*, Reviews of Modern Physics, vol. 45, No. 4, Oct. 1973, pp. 574-588.
M. Sahimi, B. D. Hughes, L. E. Scriven and H. T. Davis, *Stochastic Transport in Disordered Systems*, American Institute of Physics, J. Chem. Phys. 78(11), Jun. 1, 1983, pp. 6849-6864.
R. J. Blackwell, J. R. Rayne and W. M. Terry, *Factors Influencing the Efficiency of Miscible Displacement*, Petroleum Transactions, AIME, vol. 216, 1959, pp. 1-8.
S. Kirkpatrick, *Classical Transport in Disordered Media: Scaling and Effective-Medium Theories*, Physical Review Letters, vol. 27, No. 25, Dec. 20, 1971, pp. 1722-1725.
K. K. Mohanty, J. M. Ottino and H. T. Davis, *Reaction and Transport in Disordered Composite Media: Introduction Of Percolation Concepts*, Pergamon Press, Ltd., Chemical Engineering Science vol. 37, No. 6, 1982, pp. 905-924.
S. Verma and K. Aziz, *Two-and-Three-Dimensional Flexible Grids for Reservoir Simulation*, Paper presented at the 5th European Conference on the Mathematics of Oil Recovery, Leoben, Austria, Sep. 3-6, 1996, pp. 143-156.
Z. E. Heinemann, C. Brand, M. Munka and Y. M. Chen, *Modeling Reservoir Geometry With Irregular Grids*, SPE 18412, Feb. 6-8, 1989, pp. 37-49.
M. J. Blunt, J. W. Barker, B. Rubin, M. Mansfield, I. D. Culverwell and M. A. Christie, *Predictive Theory for Viscous Fingering in Compositional Displacement*, Society of Petroleum Engineers, Feb. 1994, pp. 73-80.
M. R. Todd, J. K. Dietrich, A. Goldburg and R. G. Larson, *Numerical Simulation of Competing Chemical Flood Designs*, SPE 7077, Apr. 16-19, 1978, pp. 409-417, (Tables 1-7), (Figs. 1-21).
Calvin C. Mattax and Robert L. Dalton, *Reservoir Simulation*, Monograph vol. 13 SPE Henry L. Doherty Series, 1990, Chapter 6 pp. 57-73.
C. A. Chase, Jr. and M. R. Todd, *Numerical Simulation of $CO_2$ Flood Performance*, Society of Petroleum Engineers Journal, Dec. 1984, pp. 597-605.
F. J. Fayers, F. Jouaux and H. A. Tchelepi, *An Improved Macroscopic Model For Viscous Fingering and its Validation for 2D and 3D Flows II. Flows Influenced by Gravity*, Department of Petroleum Engineering, Stanford University, Marcel Dekker, Inc., 1994, pp. 79-105.
F. J. Fayers, F. Jouaux and H. A. Tchelepi, *An Improved Macroscopic Model For Viscous Fingering and its Validation for 2D and 3D Flows I. Non-Gravity Flows*, Department of Petroleum Engineering, Stanford University, Marcel Dekker, Inc., 1994, pp. 43-78.
M. R. Todd, P. M. O'Dell and G. J. Hirasaki, *Methods For Increased Accuracy In Numerical Reservoir Simulators*, Society of Petroleum Engineers Journal, Dec. 1972, pp. 515-530.
P. R. King, *The Mathematics of Oil Recovery*, Clarendon Press, Oxford, 1992, pp. 116-150.
Soleng, Harald H., "Oil Reservoir Production Forecasting With Uncertainty Estimation Using Genetic Algorithms", Proceedings of the 1999 Congress on Evolutionary Computation. 1999. CEC 99. pp. 1999-1223.
Nikravesh, M. et al. "Dividing Oil Fields Into Regions With Similar Characteristics Behavior Using Neural Network and Fuzzy Logic Approaches" 1996. Biennial Conference of the North American Fuzzy Information Processing Society. 1996. NAFIPS. pp. 164-169.
Nikravesh, M. et al. "Nonlinear Control of an Oil Well", Proceedings of the 1997 American Control Conference, 1997. vol. 1, pp. 739-743.
Pajon, J. L. et al, "Visualization of Scalar Data Defined On A Structured Grid-Applications To Petroleum Research", Proceedings of the First IEEE Conference on Visualization. 1990. Visualization '90. pp. 281-288, 482-483.
Zhuang, Xinglai et al., "Parallelizing A Reservoir Simulator Using MPI", Proceedings of teh 1994 Scalable Parallel Libraries Conference. 1995. pp. 165-174.
Nghiem, L. X. et al, *A Method for Modelling Incomplete Mixing in Compositional Simulation of Unstable Displacements*, SPE 18439, Reservoir Simulation Symposium, Houston, Texas, Feb. 6-8, 1989, pp. 419-430.
D. Wilkinson and J. F. Willemsen, *Invasion percolation: a new form of percolation theory*, The Institute of Physics, 1983, pp. 3365-3376.
G. M. Homsy, *Viscous Fingering in Porous Media*, Annual Reviews, Inc., 1987, pp. 270-311.

* cited by examiner

METHOD AND SYSTEM FOR SIMULATING A HYDROCARBON-BEARING FORMATION

This application claims the benefit of U.S. Provisional Application No. 60/159,035 filed on Oct. 12, 1999.

FIELD OF THE INVENTION

This invention relates generally to simulating a hydrocarbon-bearing formation, and more specifically to a method and system for simulating a hydrocarbon-bearing formation under conditions in which a fluid is injected into the formation to displace resident hydrocarbons. The method of this invention is especially useful in modeling the effects of viscous fingering and channeling as the injected fluid flows through a hydrocarbon-bearing formation.

BACKGROUND OF THE INVENTION

In the primary recovery of oil from a subterranean, oil-bearing formation or reservoir, it is usually possible to recover only a limited proportion of the original oil present in the reservoir. For this reason, a variety of supplemental recovery techniques have been used to improve the displacement of oil from the reservoir rock. These techniques can be generally classified as thermally based recovery methods (such as steam flooding operations), waterflooding methods, and gas-drive based methods that can be operated under either miscible or immiscible conditions.

In miscible flooding operations, an injection fluid or solvent is injected into the reservoir to form a single-phase solution with the oil in place so that the oil can then be removed as a more highly mobile phase from the reservoir. The solvent is typically a light hydrocarbon such as liquefied petroleum gas (LPG), a hydrocarbon gas containing relatively high concentrations of aliphatic hydrocarbons in the $C_2$ to $C_6$ range, nitrogen, or carbon dioxide. Miscible recovery operations are normally carried out by a displacement procedure in which the solvent is injected into the reservoir through an injection well to displace the oil from the reservoir towards a production well from which the oil is produced. This provides effective displacement of the oil in the areas through which the solvent flows. Unfortunately, the solvent often flows unevenly through the reservoir.

Because the solvent injected into the reservoir is typically substantially less viscous than the resident oil, the solvent often fingers and channels through the reservoir, leaving parts of the reservoir unswept. Added to this fingering is the inherent tendency of a highly mobile solvent to flow preferentially through the more permeable rock sections or to gravity override in the reservoir.

The solvent's miscibility with the reservoir oil also affects its displacement efficiency within the reservoir. Some solvents, such as LPG, mix directly with reservoir oil in all proportions and the resulting mixtures remain single phase. Such solvent is said to be miscible on first contact or "first-contact miscible." Other solvents used for miscible flooding, such as carbon dioxide or hydrocarbon gas, form two phases when mixed directly with reservoir oil—therefore they are not first-contact miscible. However, at sufficiently high pressure, in-situ mass transfer of components between reservoir oil and solvent forms a displacing phase with a transition zone of fluid compositions that ranges from oil to solvent composition, and all compositions within the transition zone of this phase are contiguously miscible. Miscibility achieved by in-situ mass transfer of the components resulting from repeated contact of oil and solvent during the flow is called "multiple-contact" or dynamic miscibility. The pressure required to achieve multiple-contact miscibility is called the "minimum-miscibility pressure." Solvents just below the minimum miscibility pressure, called "near-miscible" solvents, may displace oil nearly as well as miscible solvents.

Predicting miscible flood performance in a reservoir requires a realistic model representative of the reservoir. Numerical simulation of reservoir models is widely used by the petroleum industry as a method of using a computer to predict the effects of miscible displacement phenomena. In most cases, there is desire to model the transport processes occurring in the reservoir. What is being transported is typically mass, energy, momentum, or some combination thereof. By using numerical simulation, it is possible to reproduce and observe a physical phenomenon and to determine design parameters without actual laboratory experiments and field tests.

Reservoir simulation infers the behavior of a real hydrocarbon-bearing reservoir from the performance of a numerical model of that reservoir. The objective is to understand the complex chemical, physical, and fluid flow processes occurring in the reservoir sufficiently well to predict future behavior of the reservoir to maximize hydrocarbon recovery. Reservoir simulation often refers to the hydrodynamics of flow within a reservoir, but in a larger sense reservoir simulation can also refer to the total petroleum system which includes the reservoir, injection wells, production wells, surface flowlines, and surface processing facilities.

The principle of numerical simulation is to numerically solve equations describing a physical phenomenon by a computer. Such equations are generally ordinary differential equations and partial differential equations. These equations are typically solved using numerical methods such as the finite element method, the finite difference method, the finite volume method, and the like. In each of these methods, the physical system to be modeled is divided into smaller gridcells or blocks (a set of which is called a grid or mesh), and the state variables continuously changing in each gridcell are represented by sets of values for each gridcell. In the finite difference method, an original differential equation is replaced by a set of algebraic equations to express the fundamental principles of conservation of mass, energy, and/or momentum within each gridcell and transfer of mass, energy, and/or momentum transfer between gridcells. These equations can number in the millions. Such replacement of continuously changing values by a finite number of values for each gridcell is called "discretization". In order to analyze a phenomenon changing in time, it is necessary to calculate physical quantities at discrete intervals of time called timesteps, irrespective of the continuously changing conditions as a function of time. Time-dependent modeling of the transport processes proceeds in a sequence of timesteps.

In a typical simulation of a reservoir, solution of the primary unknowns, typically pressure, phase saturations, and compositions, are sought at specific points in the domain of interest. Such points are called "gridnodes" or more commonly "nodes." Gridcells are constructed around such nodes, and a grid is defined as a group of such gridcells. The properties such as porosity and permeability are assumed to be constant inside a gridcell. Other variables such as pressure and phase saturations are specified at the nodes. A link between two nodes is called a "connection." Fluid flow between two nodes is typically modeled as flow along the connection between them.

Compositional modeling of hydrocarbon-bearing reservoirs is necessary for predicting processes such as first-contact miscible, multiple-contact miscible, and near-miscible gas injection. The oil and gas phases are represented by multicomponent mixtures. In such modeling, reservoir heterogeneity and viscous fingering and channeling cause variations in phase saturations and compositions to occur on scales as small as a few centimeters or less. A fine-scale model can represent the details of these adverse-mobility displacement behaviors. However, use of fine-scale models to simulate these variations is generally not practical because their fine level of detail places prohibitive demands on computational resources. Therefore, a coarse-scale model having far fewer gridcells is typically developed for reservoir simulation. Considerable research has been directed to developing models suitable for use in predicting miscible flood performance.

Development of a coarse-grid model that effectively simulates gas displacement processes is especially challenging. For compositional simulations, the upscaled, coarse-grid model must effectively characterize changes in phase behavior and changes in oil and gas compositions as the oil displacement proceeds. Many different techniques have been proposed. Most of these proposals use empirical models to represent viscous fingering in first-contact miscible displacement. See for example:

Koval, E. J., "A Method for Predicting the Performance of Unstable Miscible Displacement in Heterogeneous Media," *Society of Petroleum Engineering Journal*, pages 145–154, June 1963;

Dougherty, E. L., "Mathematical Model of an Unstable Miscible Displacement," *Society of Petroleum Engineering Journal*, pages 155–163, June 1963;

Todd, M. R., and Longstaff, W. J., "The Development, Testing, and Application of a Numerical Simulator for Predicting Miscible Flood Performance," *Journal of Petroleum Technology*, pages 874–882, July 1972;

Fayers, F. J., "An Approximate Model with Physically Interpretable Parameters for Representing Miscible Viscous Fingering," *SPE Reservoir Engineering*, pages 542–550, May 1988; and Fayers, F. J. and Newley, T. M. J., "Detailed Validation of an Empirical Model for Viscous Fingering with Gravity Effects," *SPE Reservoir Engineering, pages* 542–550, May 1988.

Of these models, the Todd-Longstaff ("T-L") mixing model is the most popular, and it is used widely in reservoir simulators. When properly used, the T-L mixing model provides reasonably accurate average characteristics of adverse-mobility displacements when the injected solvent and oil are first-contact miscible. However, the T-L mixing model is less accurate under multiple-contact miscible conditions.

Models have been suggested that use the T-L model to account for viscous fingering under multiple-contact miscible situations (see for example Todd, M. R. and Chase, C. A., "A Numerical Simulator for Predicting Chemical Flood Performance," SPE-7689, presented at the 54th Annual Fall Technical Conference and Exhibition of the Society of Petroleum Engineers, Houston, Tex., 1979, sometimes referred to as the "Todd-Chase technique"). In modeling a multiple-contact miscible displacement, in addition to the viscous fingering taken into account in the T-L mixing model, exchange of solvent and oil components between phases according to the phase behavior relations must also be considered. The importance of the interaction between phase behavior and fingering in multiple-contact miscible displacements was disclosed by Gardner, J. W., and Ypma, J. G. J., "An Investigation of Phase-Behavior/Macroscopic Bypassing Interaction in $CO_2$ Flooding," *Society of Petroleum Engineering Journal*, pages 508–520, October 1984. However, these proposals did not effectively combine use of a mixing model and a phase behavior model.

Another proposed model for taking into account fingering and channeling behavior in multiple-contact miscible displacement suggested making the dispersivities of solvent and oil components dependent on the viscosity gradient, thereby addressing the macroscopic effects of viscous fingering (see Young, L. C., "The Use of Dispersion Relationships to Model Adverse Mobility Ratio Miscible Displacements," paper SPE/DOE 14899 presented at the 1986 SPE/DOE Enhanced Oil Recovery Symposium, Tulsa, April 20–23). Another model proposed extending the T-L model to multiphase multicomponent flow with simplified phase behavior predictions (see Crump, J. G., "Detailed Simulations of the Effects of Process Parameters on Adverse Mobility Ratio Displacements," paper SPE/DOE 17337, presented at the 1988 SPE/DOE Enhanced Oil Recovery Symposium, Tulsa, April 17–20). A still another model suggested using the fluid compositions flowing out of a large gridcell to compensate for the nonuniformity of the fluid distribution in the gridcell (see Barker, J. W., and Fayers, F. J., "Transport Coefficients for Compositional Simulation with Coarse Grids in Heterogeneous Media", SPE 22591, presented at SPE 66th Annual Tech. Conf., Dallas, Tex., Oct. 6–9, 1991). A still another model proposed that incomplete mixing between solvent and oil can be represented by assuming that thermodynamic equilibrium prevails only at the interface between the two phases, and a diffusion process drives the oil and solvent composition towards these equilibrium values (see Nghiem, L. X., and Sammon, P. H., "A Non-Equilibrium Equation-of-State Compositional Simulator," SPE 37980, presented at the 1997 SPE Reservoir Simulation Symposium, Dallas, Tex., Jun. 8–17, 1997). The gridcells in these models were not subdivided.

Proposals have been made to represent fingering and channeling in multiple-contact miscible displacements using two-region models. See for example:

Nghiem, L. X., Li, Y. K. and Agarwal, R. K., "A Method for Modeling Incomplete Mixing in Compositional Simulation of Unstable Displacements," SPE 18439, presented at the 1989 Reservoir Simulation Symposium, Houston, Tex., Feb. 6–8, 1989; and Fayers, F. J., Barker, J. W., and Newley, T. M. J., "Effects of Heterogeneities on Phase Behavior in Enhanced Oil Recovery," in *The Mathematics of Oil Recovery*, P. R. King, editor, pages 115–150, Clarendon Press, Oxford, 1992.

These models divide a simulation gridcell into a region where complete mixing occurs between the injected solvent and a portion of the resident oil and a region where the resident oil is bypassed and not contacted by the solvent. Although the conceptual structure of these models appears to provide a better representation of incomplete mixing in multiple-contact miscible displacements than single zone models, the physical basis of the equations used to represent bypassing and mixing is unclear. In particular, these models (1) use empirical correlations to represent oil/solvent mobilities in each region, (2) use empirical correlations to represent component transfer between regions, and (3) make restrictive assumptions about the composition of the regions and direction of component transfer between the regions. It has been suggested that the empirical mobility and mass transfer functions in these models can be determined by fitting them to the results of fine-grid simulations. As a result, in practice, calibration of these models will be a time-consuming and expensive process. Furthermore, these models are unlikely to accurately predict performance outside the parameter ranges explored in the reference fine-grid simulations.

While the two-region approaches proposed in the past have certain advantages, there is a continuing need for improved simulation models that provide a better physical representation of bypassing and mixing in adverse mobility displacement and thus enable more accurate and efficient prediction of flood performance.

SUMMARY

A method and system is provided for simulating one or more characteristics of a multi-component, hydrocarbon-bearing formation into which a displacement fluid having at least one component is injected to displace formation hydrocarbons. The first step of the method is to equate at least part of the formation to a multiplicity of gridcells. Each gridcell is then divided into two regions, a first region representing a portion of each gridcell swept by the displacement fluid and a second region representing a portion of each gridcell essentially unswept by the displacement fluid. The distribution of components in each region is assumed to be essentially uniform. A model is constructed that is representative of fluid properties within each region, fluid flow between gridcells using principles of percolation theory, and component transport between the regions. The model is then used in a simulator to simulate one or more characteristics of the formation.

BRIEF DESCRIPTION OF THE DRAWINGS

The present invention and its advantages will be better understood by referring to the following detailed description and the following drawings in which like numerals have similar functions.

The drawings illustrate specific embodiments of practicing the method of this invention. The drawings are not intended to exclude from the scope of the invention other embodiments that are the result of normal and expected modifications of the specific embodiments.

DETAILED DESCRIPTION OF THE INVENTION

In order to more fully understand the present invention, the following introductory comments are provided. To increase the recovery of hydrocarbons from subterranean formation, a variety of enhanced hydrocarbon recovery techniques have been developed whereby a fluid is injected into a subterranean formation at one or more injection wells within a field and hydrocarbons (as well as the injected fluid) are recovered from the formation at one or more production wells within the field. The injection wells are typically spaced apart from the production wells, but one or more injection wells could later be used as production wells. The injected fluid can for example be a heating agent used in a thermal recovery process (such as steam), any essentially immiscible fluid used in an immiscible flooding process (such as natural gas, water, or brine), and any miscible fluid used in a miscible flooding process (for example, a first-contact miscible fluid, such as liquefied petroleum gas, or a multiple-contact miscible or near-miscible fluid such as lower molecular weight hydrocarbons, carbon dioxide, or nitrogen).

Figure 1:
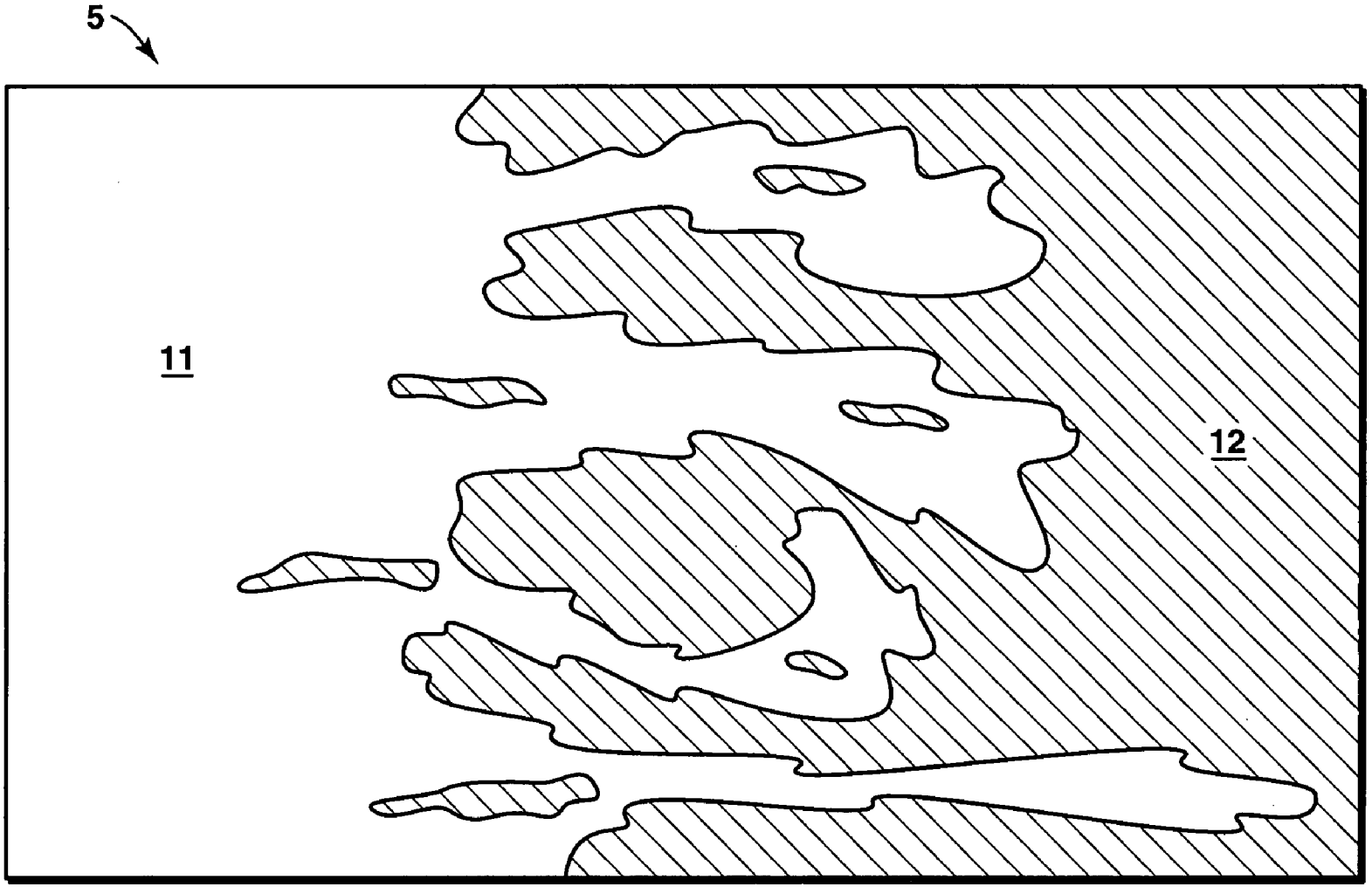
FIG. 1 illustrates a two-dimensional schematic of a solvent flowing through an oil reservoir to displace oil therefrom, which shows an example of solvent fingering in the reservoir.

FIG. 1 schematically illustrates a two-dimensional reservoir area 5 which is part of a larger oil-bearing, geologic formation (not shown) to be analyzed using the method of this invention. In FIG. 1, an injected fluid 11, which is assumed to be gaseous in this description, displaces a multi-component resident oil 12 in the reservoir area 5. It should be understood that this invention is not limited to a gaseous injected fluid; the injected fluid could also be liquid or a multi-phase mixture. The injected fluid 11 flows from left to right in the drawing. FIG. 1 depicts viscous fingering that occurs when the injected fluid 11 displaces resident oil 12. The injected fluid 11 tends to finger through the oil 12 towards a producing well (not shown in the drawing), resulting in premature breakthrough of the injected fluid 11 and bypassing some of the resident oil 12. Viscous fingering is dominantly caused by large differences in oil 12 and injected fluid 11 viscosities resulting in a mobility ratio of injected fluid-to-oil that has an adverse effect on areal sweep efficiency or displacement efficiency of the injected fluid.

Through advanced reservoir characterization techniques, the reservoir area 5 can be represented by gridcells on a scale from centimeters to several meters, sometimes called a fine-scale grid. Each gridcell can be populated with a reservoir property, including for example rock type, porosity, permeability, initial interstitial fluid saturation, and relative permeability and capillary pressure functions.

Figure 2:
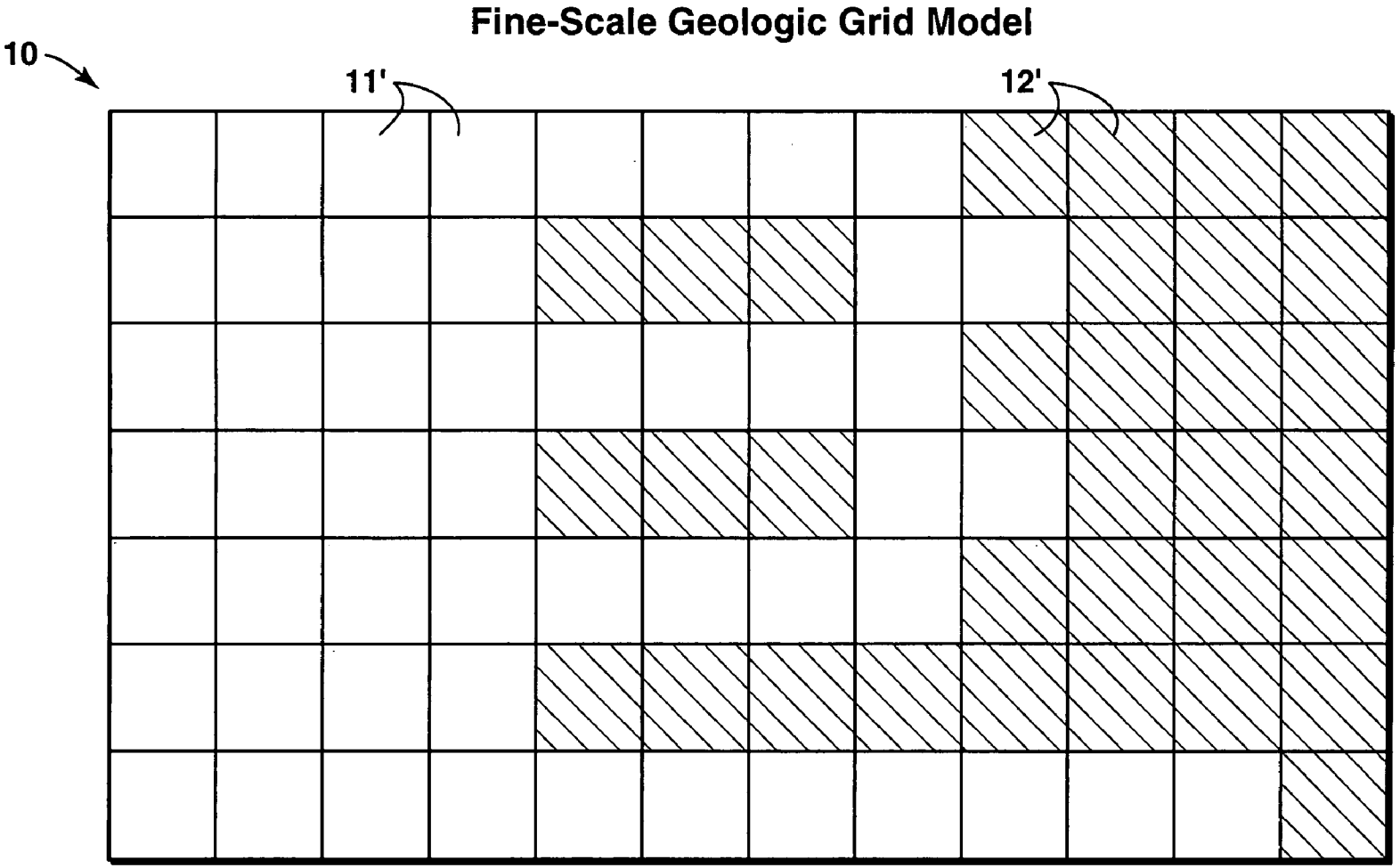
FIG. 2 illustrates an example of a two-dimensional fine-scale grid that could represent the reservoir area of FIG. 1.

FIG. 2 shows an example of a two-dimensional fine-scale grid 10 that could represent the reservoir area 5 of FIG. 1. The reservoir area 5 of FIG. 1 is represented in FIG. 2 by 84 gridcells. Gridcells 11' represent the geologic regions that have been swept by injected fluid 11 and the gridcells 12' represent the geologic regions that contain essentially resident oil 12 undisplaced by the injected fluid. However, reservoir simulations are not typically performed with such fine-scale grids. The direct use of fine-scale models for full-field reservoir simulation is not generally feasible because their fine level of detail places prohibitive demands on computational resources. Therefore, a coarse-scale grid is typically used in simulation models, while preserving, as much as possible, the fluid flow characteristics and phase behavior of the fine-scale grid. A coarse-scale grid may represent, for example, all 84 gridcells of FIG. 2 by one gridcell. A method is therefore needed to model fluid compositions and fluid flow behavior taking into account fingering and channeling. The method of this invention provides this capability.

The method of this invention begins by equating the reservoir area to be analyzed to a suitable grid system. The reservoir area to be analyzed is represented by a multiplicity of gridcells, arranged adjacent to one another so as to have a boundary between each pair of neighboring gridcells. This spatial discretization of the reservoir area can be performed using finite difference, finite volume, finite element, or similar well-known methods that are based on dividing the physical system to be modeled into smaller units. The present invention is described primarily with respect to use of the finite difference method. Those skilled in the art will recognize that the present invention can also be applied in connection with finite element methods or finite volume methods. When using the finite difference and finite volume methods, the smaller units are typically called gridcells, and when using the finite element method the smaller units are typically called elements. These gridcells or elements can number from fewer than a hundred to millions. In this patent, for simplicity of presentation, the term gridcell is used, but it should be understood that if a simulation uses the finite element method the term element would replace the term gridcell as used in this description.

In the practice of this invention, the gridcells can be of any geometric shape, such as parallelepipeds (or cubes) or hexahedrons (having four vertical corner edges which may vary in length), or tetrahedra, rhomboids, trapezoids, or triangles. The grid can comprise rectangular gridcells organized in a regular, structured pattern (as illustrated in FIG. 2), or it can comprise gridcells having a variety of shapes laid out in an irregular, unstructured pattern, or it can comprise a plurality of both structured and unstructured patterns. Completely unstructured grids can be assembled that assume almost any shape. All the gridcells are preferably boundary aligned, thereby avoiding having any side of a gridcell contacting the sides of two other gridcells.

One type of flexible grid that can be used in the model of this invention is the Voronoi grid. A Voronoi gridcell is defined as the region of space that is closer to its node than to any other node, and a Voronoi grid is made of such gridcells. Each gridcell is associated with a node and a series of neighboring gridcells. The Voronoi grid is locally orthogonal in a geometrical sense; that is, the gridcell boundaries are normal to lines joining the nodes on the two sides of each boundary. For this reason, Voronoi grids are also called perpendicular bisection (PEBI) grids. A rectangular grid block (Cartesian grid) is a special case of the Voronoi grid. The PEBI grid has the flexibility to represent widely varying reservoir geometry, because the location of nodes can be chosen freely. PEBI grids are generated by assigning node locations in a given domain and then generating gridcell boundaries in a way such that each gridcell contains all the points that are closer to its node location than to any other node location. Since the inter-node connections in a PEBI grid are perpendicularly bisected by the gridcell boundaries, this simplifies the solution of flow equations significantly. For a more detailed description of PEBI grid generation, see Palagi, C. L. and Aziz, K.: "Use of Voronoi Grid in Reservoir Simulation," paper SPE 22889 presented at the 66th Annual Technical Conference and Exhibition, Dallas, Tex. (Oct. 6–9, 1991).

The next step in the method of this invention is to divide each gridcell that has been invaded by the injected fluid into two regions, a first region that represents a portion of the gridcell swept by the injected fluid 11 and a second region that represents a portion of the gridcell that is unswept by the injected fluid 11. The distribution of components in each region is assumed to be uniform. It is further assumed that fluids within each region are at thermodynamic equilibrium. However, the two regions of the gridcell are not in equilibrium with each other, and as a result the compositions and phase volume fractions within each region will typically be different.

Figure 3:
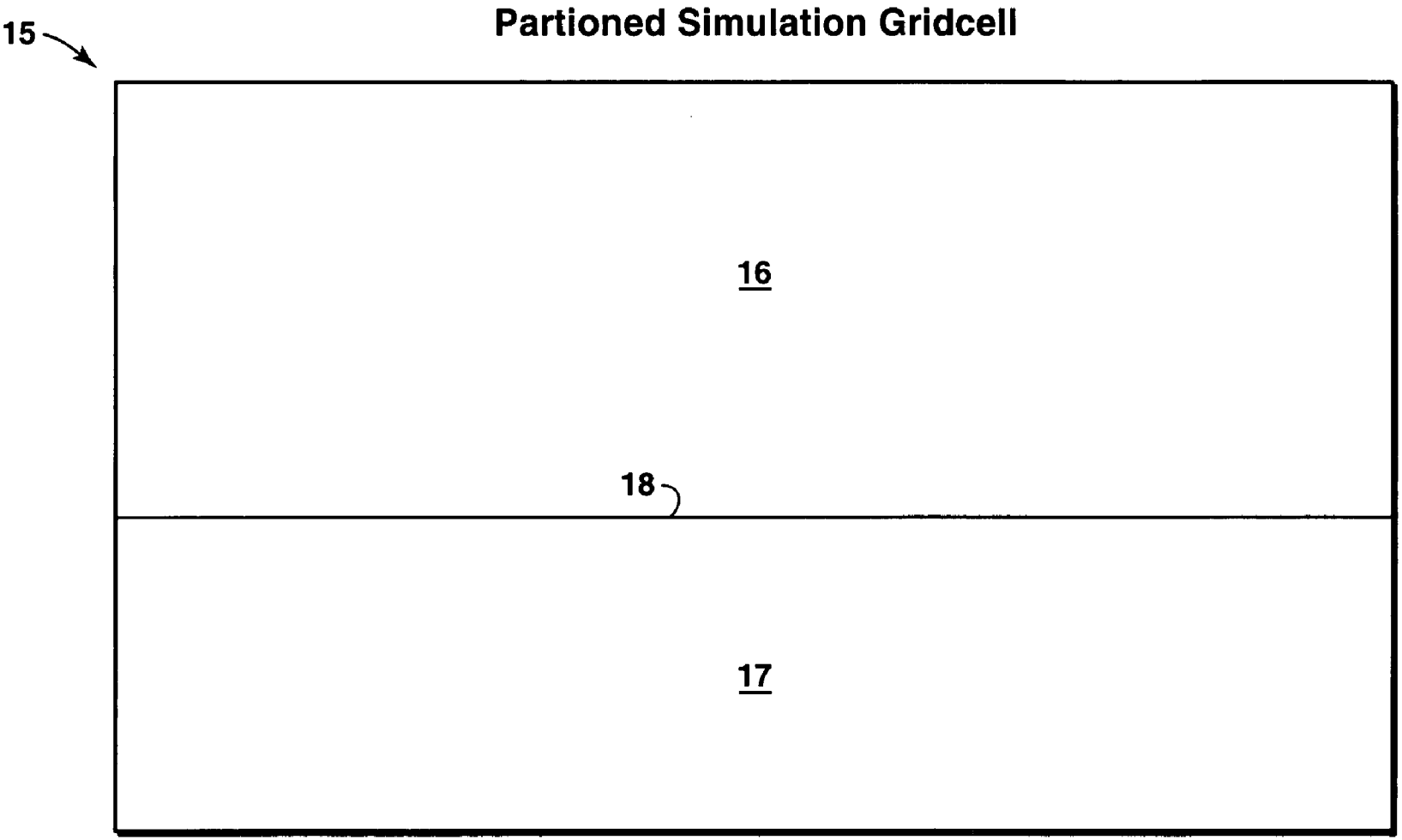
FIG. 3 illustrates a two-dimensional gridcell covering the same domain depicted in FIG. 1, with the gridcell divided into two regions, one representing the region of the domain swept by an injected fluid and the second region representing the region of the domain unswept by the injected fluid.

FIG. 3 illustrates a two-dimensional schematic of one grid gridcell 15 that represents the same reservoir area represented by the 84 gridcells of grid 10 (FIG. 2). While not shown in the drawing, it should be understood that gridcell 15 shares boundaries with neighboring gridcells. The following description with respect to gridcell 15 also applies to other gridcells in the grid of which gridcell 15 is only one of a multiplicity of gridcells.

Referring to FIG. 3, gridcell 15 is divided into two regions 16 and 17. Region 16 represents the portion of the gridcell invaded by the injected fluid 11 and region 17 represents the portion of the gridcell that has not been displaced by the injected fluid 11. Regions 16 and 17 are separated by an interface or partition 18 that is assumed to have infinitesimal thickness. Multicomponent fluids within each region are assumed to be in thermodynamic equilibrium, which means that the fluid compositions and phase volumes of regions 16 and 17 could be different, and typically are different. The compositions of fluids can vary from gridcell to gridcell within the grid and the compositions of fluids within each region of a gridcell can vary with time. Therefore, partition 18 can move as a function of time as the injected fluid 11 contacts more of the region represented by gridcell 15. Movement of partition 18 depends primarily on (1) exchange of fluids between gridcell 15 and its neighboring gridcells, (2) mass transfer across the partition 18, and (3) injection or withdrawal of fluids through injection and production wells that may penetrate the geologic region represented by gridcell 15.

Figure 4:
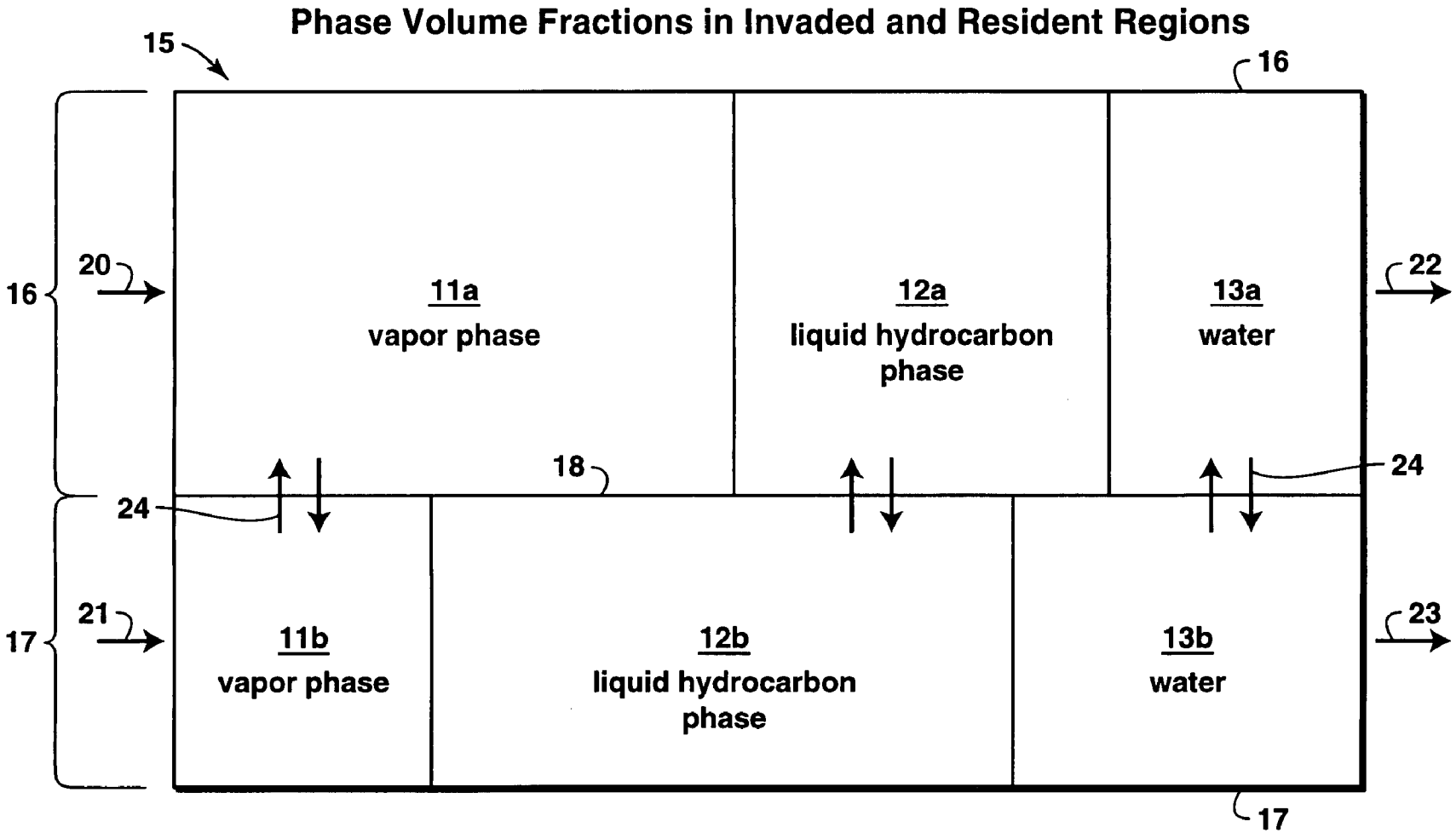
FIG. 4 illustrates the gridcell depicted in FIG. 3 showing schematically phase fractions in the two regions of the gridcell.

FIG. 4 illustrates an example of phase fractions of fluids in regions 16 and 17. The fraction of vapor phase, which consists of the injected fluid plus vaporized oil, is shown by numeral 11*a* in region 16 and by numeral 11*b* in region 17. The fraction of liquid phase, which consists of resident oil plus dissolved injected fluid, is shown by numeral 12*a* in region 16 and by numeral 12*b* in region 17. The fraction of water is shown by numeral 13*a* in region 16 and numeral 13*b* in region 17. In the example shown in FIG. 4, region 16 contains primarily the high-mobility injected fluid 11 and region 17 contains primarily the low-mobility resident oil 12. Arrow 20 represents a fluid stream flowing into region 16 from invaded regions of gridcells adjacent to gridcell 15. Arrow 21 represents a fluid stream flowing into region 17 from resident regions of gridcells adjacent to gridcell 15. Arrow 22 represents a fluid stream flowing out of region 16 into invaded regions of gridcells adjacent to gridcell 15. Arrow 23 represents a fluid stream flowing out of region 17 into resident regions of gridcells adjacent to gridcell 15. Although the arrows show fluid flowing from left to right, the fluid could flow into and out of gridcell 15 in other directions. Arrows 24 represent mass transfer between regions 16 and 17. Components are allowed to transfer in either direction across the partition 18. Although the arrows 24 show transfer between phases of the same type (vapor to vapor, liquid hydrocarbon to liquid hydrocarbon, and water to water), components may transfer from any phase in the source region into any phase in the other region. Region 16 has zero volume until injected fluid 11 flows into gridcell 15. Injected fluid 11 may be modeled as being injected into either the invaded region 16 or resident region 17, or the injected fluid 11 may be modeled as being injected simultaneously into both regions 16 and 17. Fluids may be withdrawn from both invaded region 16 and resident region 17. Gridcell 15 can also be modeled as having injected fluid 11 flowing from one or more injection wells directly into gridcell 15, and it can be modeled as having fluid flowing directly out of gridcell 15 into one or more production wells. Although not shown in the drawings, if the reservoir area represented by gridcell 15 is penetrated by an injection well, injected fluid 11 injected into gridcell 15 could be modeled as being injected only into the invaded region 16 and if the reservoir area represented by gridcell 15 is penetrated by a production well, gridcell 15 could be modeled as having fluids being produced from both invaded region 16 and resident region 17.

Although the drawings do not show gridcell nodes, persons skilled in the art would understand that each gridcell would have a node. In simulation operations, flow of fluid between gridcells would be assumed to take place between gridcell nodes, or, stated another way, through inter-node connections. In practicing the method of this invention, the invaded region of a given gridcell (region 16 of FIGS. 3 and 4) is connected to invaded regions of gridcells adjacent to the given gridcell, and the resident regions of a given gridcell (region 17 of FIGS. 3 and 4) is connected to resident regions of gridcells adjacent to the given gridcell. There are no inter-node connections between resident region 16 and invaded region 17. The inventors therefore sometimes refer to the method of this invention as the Partitioned Node Model or PNM.

The next step in the method of this invention is to construct a predictive model that represents fluid properties within each region of each gridcell, fluid flow between each gridcell and its neighboring gridcells, and component transport between regions 16 and 17 for each gridcell. In a preferred embodiment, the model comprises a set of finite difference equations for each gridcell having functions representative of the mobility of each fluid phase in regions 16 and 17, functions representative of the phase behavior within regions 16 and 17, and functions representative of the mass transfer of each component between the regions 16 and 17. The model may optionally further contain functions representing energy transfer between regions 16 and 17. Energy transfer functions may be desired for example to simulate the heat effects resulting from a steam flooding operation.

Mobility functions are used to describe flow through the connections, and a mobility function is generated for each phase in each region. The mobilities of the streams 22 and 23 leaving the gridcell 15 depend on many factors including the composition of the fluids in the invaded region 16 and the resident region 17, the relative sizes (or volume fraction) of the invaded region 16 and resident region 17, the heterogeneity of the gridcell, and the oil-to-injected fluid mobility ratio. The specific functional dependencies are determined through the use of percolation theory. The basic principles of percolation theory are described by S. Kirkpatrick, "Percolation and Conduction," *Rev. Modern Physics*, vol. 45, pages 574–588, 1973, which is incorporated herein by reference. In a preferred embodiment, an effective medium mobility model represents the gridcell by a pore network so as to characterize the effect of fingering and channeling that occurs in the gridcell depending on conditions prevalent in the gridcell over a time interval. The effective mobility of each fluid phase in each region of a gridcell can be calculated by those skilled in the art having benefit of the teaching of this description. Examples of phase mobility equations, derived from an effective medium model, are provided below as equations (18)–(20).

The method of this invention assumes that equilibrium exists within the invaded region 16 and within resident region 17. As part of the model, a determination is made of the properties of the phases that coexist within regions 16 and 17. Preferably, a suitable equation of state is used to calculate the phase behavior of region 16 and region 17. In the examples provided below, a one-dimensional model uses a simplified pseudoternary phase behavior model that characterizes mixtures of solvent and oil in terms of three pseudocomponents, solvent ($CO_2$), a light oil component, and a heavy oil component. The simplified phase behavior model is capable of simulating the salient features of displacements involving different degrees of miscibility ranging from first contact miscible, through multiple-contact miscible, and near-miscible, to immiscible. The phase behavior properties can be determined by persons of ordinary skill in the art.

The method of this invention does not assume equilibrium between the invaded region 16 and the resident region 17 of a gridcell. Mass transfer functions are used to describe the rate of movement of components across the interface or partition 18 between regions 16 and 17. This mass transfer is depicted in FIG. 4 by arrows 24. Mechanisms of mass transfer include, but are not limited to, molecular diffusion, convective dispersion, and capillary dispersion. The method of this invention assumes that each component's rate of mass transfer is proportional to a driving force times a resistance. Examples of driving forces include, but are not limited to, composition differences and capillary pressure differences between the two regions. Once a mass transfer function is generated for each fluid component, the rates of mass transfer depend on factors, including, but not limited to, component identity, degree of miscibility between the gas and oil, size of each region, gridcell geometry, gas/oil mobility ratio, velocity, heterogeneity, and water saturation. These functionalities can be built into the mass transfer model by those skilled in the art. Examples of mass transfer functions are provided as equations (10) and (14)–(16) below.

One of the first steps in designing the model is to select the number of space dimensions desired to represent the geometry of the reservoir. Both external and internal geometries must be considered. External geometries include the reservoir or aquifer limits (or an element of symmetry) and the top and bottom of the reservoir or aquifer (including faults). Internal geometries comprises the areal and vertical extent of individual permeability units and non-pay zones that are important to the solution of the problem and the definition of well geometry (for example, well diameter, completion interval, and presence of hydraulic fractures emanating from the well).

The model of this invention is not limited to a particular number of dimensions. The predictive model can be constructed for one-dimensional (1-D), two-dimensional (2-D), and three-dimensional (3-D) simulation of a reservoir. A 1-D model would seldom be used for reservoir-wide studies because it can not model areal and vertical sweep. A 1-D gas injection model to predict displacement efficiencies can not effectively represent gravity effects perpendicular to the direction of flow. However, 1-D gas injection models can be used to investigate the sensitivity of reservoir performance to variations in process parameters and to interpret laboratory displacement tests.

2-D areal fluid injection models can be used when areal flow patterns dominate reservoir performance. For example, areal models normally would be used to compare possible well patterns or to evaluate the influence of areal heterogeneity on reservoir behavior. 2-D cross-sectional and radial gas injection models can be used when flow patterns in vertical cross-sections dominate reservoir performance. For example, cross-sectional or radial models normally would be used to model gravity dominated processes, such as crestal gas injection or gas injection into reservoirs having high vertical permeability, and to evaluate the influence of vertical heterogeneity on reservoir behavior.

3-D models may be desirable to effective represent complex reservoir geometry or complex fluid mechanics in the reservoir. The model can for example be a 3-D model comprising layers of PEBI grids, which is sometimes referred to in the petroleum industry as 2½-D. The layered PEBI grids are unstructured areally and structured (layered) vertically. Construction of layered 3-D grids is described by (1) Heinemann, Z. E., et al., "Modeling Reservoir Geometry With Irregular Grids," *SPE Reservoir Engineering*, May, 1991 and (2) Verma, S., et al., "A Control Volume Scheme for Flexible Grids in Reservoir Simulation," SPE 37999, SPE Reservoir Simulation Symposium, Dallas, Tex., June, 1997.

The present invention is not limited to dividing a gridcell into only two zones. The method of this invention could be used with gridcells having multiple partitions, thus dividing the gridcells into three or more zones. For example, a three-zone gridcell may have one zone representing the region of the reservoir invaded by an injected fluid, a second zone representing the region of the reservoir uninvaded by the injected fluid, and a third zone representing a mixing region of the reservoir's resident fluid and the injected fluid. In another example, in a steam injection operation, one zone may represent the region of the reservoir invaded by the injected steam, a second zone may represent the region of the reservoir occupied by gas other than steam, and a third zone may represent the region of the reservoir not occupied by the injected steam or the other gas. The gas other than steam could be, for example, solution gas that has evolved from the resident oil when the reservoir pressure falls below the bubble point of the oil, or a second injected gas such as enriched gas, light hydrocarbon gas, or $CO_2$.

The method of this invention can be used to simulate recovery of oil from viscous oil reservoirs in which thermal energy is introduced into the reservoir to heat the oil, thereby reducing its viscosity to a point that the oil can be made to flow. The thermal energy can be in a variety of forms, including hot waterflooding and steam injection. The injection can be in one or more injection wells and production of oil can be through one or more spaced-apart production wells. One well can also be used for both injection of fluid and production of oil. For example, in the "huff and puff" process, steam is introduced through a well (which can be a vertical or horizontal well) into a viscous hydrocarbon deposit for a period of time, the well is shut in to permit the steam to heat the hydrocarbon, and subsequently the well is placed on production.

Once the predictive model is generated, it can be used in a simulator to simulate one or more characteristics of the formation as a function of time. The basic flow model consists of the equations that govern the unsteady flow of fluids in the reservoir grid network, wells, and surface facilities. Appropriate numerical algorithms can be selected by those skilled in the art to solve the basic flow equations. Examples of numerical algorithms that can be used are described in *Reservoir Simulation*, Henry L. Doherty Series Monograph, Vol. 13, Mattax, C. C. and Dalton, R. L., editors, Society of Petroleum Engineers, Richardson, Tex., 1990. The simulator is a collection of computer programs that implement the numerical algorithms on a computer.

Persons skilled in the art will readily understand that the practice of the present invention is computationally intense. Accordingly, use of a computer, preferably a digital computer, to practice the invention is virtually a necessity. Computer programs for various portions of the modeling process are commercially available (for example, software is commercially available to develop gridcells, display results, calculate fluid flow properties, and solve linear set of equations that are used in a simulator). Computer programs for other portions of the invention could be developed by persons skilled in the art based on the teachings set forth herein.

The practice of this invention can be applied to part or all gridcells in a grid system being modeled. To economize on computational time, the additional computations associated with dividing gridcells into two or more zones is preferably applied only to those gridcells simulation model that are being invaded by injected fluid.

The method of this invention is an improvement over two-region displacement models used in the past. This improvement can be attributed to the following key differences. First, percolation theory is used to characterize the effect of fingering and channeling on effective fluid mobilities. Second, the rate of component transfer between regions is proportional to a driving force times a resistance. Third, the mass transfer functions account for actual mixing processes such as molecular diffusion, convective dispersion, and capillary dispersion. These improvements result in more accurate and efficient prediction of adverse mobility displacements.

One-Dimensional Simulation Examples

A one-dimensional model of this invention was generated and the model was tested using a proprietary simulator. Commercially available simulators could be readily modified by those skilled in the art using the teachings of this invention and the assumptions presented herein to produce substantially similar results to those presented below. In the model, allocation of components between resident and invaded regions was determined by transport equations that accounted for convection of the invaded and resident fluids and the rate of each component's transfer between the regions. A four-component fluid description was used in the simulator. The four components were solvent ($CO_2$), a light fraction of crude oil, a heavy fraction of crude oil, and water. It was assumed that the fluids were incompressible and that ideal mixing occurred, which allowed the pressure equations to be de-coupled from the component transport equations and substitution of volume fractions for mole fractions as the compositional variables. Persons skilled in the art would be familiar with techniques of accounting for fluid compressibilities and non-ideal mixing. It was also assumed that the solvent did not transfer into the resident region and that water saturation was the same in both regions.

The following description of the simulation examples refers to equations having a large number of mathematical symbols, many of which are defined as they occur throughout the text. Additionally, for purposes of completeness, a table containing definitions of symbols used herein is presented following the detailed description.

The simulator was formulated in terms of the standard transport equations for the total amount of each component, augmented by transport equations for the amount of each component in the resident region. The amount of each component in the invaded region was then obtained by difference. Under these assumptions, the dimensionless transport equations for total solvent, heavy component of the oil, and water were, respectively:

$$\frac{\partial w_1}{\partial \tau} = \frac{\partial}{\partial \xi}\left[\frac{(\lambda_{ive} y_1 + \lambda_{ile} x_1 + \lambda_{roe} x_{r1})\left(\beta\lambda_w \frac{\partial p_c}{\partial \xi} - 1\right)}{\lambda_t}\right] \tag{1}$$

$$\frac{\partial w_2}{\partial \tau} = \frac{\partial}{\partial \xi}\left[\frac{(\lambda_{ive} y_2 + \lambda_{ile} x_2 + \lambda_{roe} x_{r2})\left(\beta\lambda_w \frac{\partial p_c}{\partial \xi} - 1\right)}{\lambda_t}\right] \tag{2}$$

$$\frac{\partial S_w}{\partial \tau} = \frac{\partial}{\partial \xi}\left[\beta\left(\frac{\lambda_w}{\lambda_t} - 1\right)\lambda_w \frac{\partial p_c}{\partial \xi} - \frac{\lambda_w}{\lambda_t}\right] \tag{3}$$

The total light component volume fraction, $w_3$, was obtained from:

$$w_3 = 1 - w_1 - w_2 - S_w \tag{4}$$

In Eq. (4), component 1 is solvent, component 2 is the heavy fraction of the oil, and component 3 is the light fraction of the oil.

In Eqs. (1) through (4), $\xi \equiv x/L$, $\tau \equiv ut/\phi L$, $\beta \equiv k/uL$, $\lambda_t \equiv \lambda_{ive} + \lambda_{ile} + \lambda_{roe} + \lambda_w$, L is core length, k is permeability, $\phi$ is porosity, $p_c$ is the capillary pressure between oil and water, $y_j$ is the volume fraction of component j in the vapor portion of the invaded region, $x_j$ is the volume fraction of component j in the liquid portion of the invaded region, and $x_{rj}$ is the volume fraction of component j in the nonaqueous portion of the resident region. $W_j \equiv w_{rj} + W_{ij}$ is the total volume fraction of component j, where $w_{ij} \equiv \theta(S_g y_j + S_1 x_j)$ is the volume fraction of component j in the invaded region and $w_{rj} \equiv (1-\theta)(1-S_w)x_{rj}$ is the volume fraction of component j in the resident region. $\theta$ is the volume fraction of the invaded region, defined as:

$$\theta \equiv 1 - \frac{w_{r1} + w_{r2} + w_{r3}}{w_1 + w_2 + w_3} \tag{5}$$

$S_g$ and $S_1$ are, respectively, the vapor and liquid saturations in the invaded region. $\lambda_{roe}$ is the mobility of the resident fluid, $\lambda_{ive}$ is the mobility of the vapor phase in the invaded region, $\lambda_{ile}$ is the mobility of the liquid phase in the invaded region, and $\lambda_w$ is the mobility of water, all calculated using effective medium theory, as described below. The total injection velocity, u, was assumed to be constant.

The dimensionless transport equations for resident solvent, heavy oil, and light oil were, respectively:

$$\frac{\partial w_{r1}}{\partial \tau} = \frac{\partial}{\partial \xi}\left[\frac{\lambda_{roe} x_{r1}\left(\beta\lambda_w \frac{\partial p_c}{\partial \xi} - 1\right)}{\lambda_t}\right] - \frac{\Lambda_1 \phi L}{u} \tag{6}$$

$$\frac{\partial w_{r2}}{\partial \tau} = \frac{\partial}{\partial \xi}\left[\frac{\lambda_{roe} x_{r2}\left(\beta\lambda_w \frac{\partial p_c}{\partial \xi} - 1\right)}{\lambda_t}\right] - \frac{\Lambda_2 \phi L}{u} \tag{7}$$

$$\frac{\partial w_{r3}}{\partial \tau} = \frac{\partial}{\partial \xi}\left[\frac{\lambda_{roe} x_{r3}\left(\beta\lambda_w \frac{\partial p_c}{\partial \xi} - 1\right)}{\lambda_t}\right] - \frac{\Lambda_3 \phi L}{u} \tag{8}$$

where $\Lambda_j$ is the rate of transfer (volume/time) of component j from the resident to invaded region. The first term on the right side of these equations accounted for convection of each component within the resident region, and the second term accounted for transfer of each component from the resident region to the invaded region.

The equation for pressure was:

$$\frac{\partial p}{\partial \xi} = \frac{\left(\lambda_w \frac{\partial p_c}{\partial \xi} - \frac{1}{\beta}\right)}{\lambda_t} \tag{9}$$

In the one-dimensional simulator, equations (1) through (3) and (6) through (8) were discretized to produce six sets of finite-difference equations in $\xi$, which are solved time-wise with Hamming's predictor-corrector method of integrating a set of first-order ordinary differential equations (the Hamming method would be familiar to those skilled in the art). It was assumed that no invaded region was present prior to solvent injection and that therefore $\theta$ was initially zero throughout the model. Formation of the invaded region was triggered by assuming that solvent went exclusively into the invaded region at the injection face of the core. After the $w_i$, $w_{ri}$, and $S_w$ are calculated from the above integration, $\theta$ was updated with Eq. (5), and the integration proceeded to the next time step. The pressure distribution at each time step was then determined by integrating Eq. (9) with respect to $\xi$.

Mass Transfer Function

It was assumed that, as a first approximation, the rate of inter-region transfer was proportional to the difference between the component's volume fraction in the resident and invaded regions:

$$\Lambda_j = \kappa_j(x_j - x_{ij}) \tag{10}$$

where $\kappa_j$ was the mass transfer coefficient for component j [units: time$^{-1}$], and $x_{rj}$ and $x_{ij} \equiv (S_g y_j + S_1 x_j)/(1-S_w)$ were the volume fractions of component j in the resident and invaded regions respectively. In equation (10), the volume fraction difference was the driving force for mass transfer and the mass transfer coefficient characterized the resistance to mass transfer. With this assumption, equations (6) through (8) became:

$$\frac{\partial w_{r1}}{\partial \tau} = \frac{\partial}{\partial \xi}\left[\frac{\lambda_{roe} x_{r1}\left(\beta\lambda_w \frac{\partial p_c}{\partial \xi} - 1\right)}{\lambda_t}\right] - Da_1(x_{r1} - x_{i1}) \tag{11}$$

$$\frac{\partial w_{r2}}{\partial \tau} = \frac{\partial}{\partial \xi}\left[\frac{\lambda_{roe} x_{r2}\left(\beta\lambda_w \frac{\partial p_c}{\partial \xi} - 1\right)}{\lambda_t}\right] - Da_2(x_{r2} - x_{i2}) \tag{12}$$

$$\frac{\partial w_{r3}}{\partial \tau} = \frac{\partial}{\partial \xi}\left[\frac{\lambda_{roe} x_{r3}\left(\beta\lambda_w \frac{\partial p_c}{\partial \xi} - 1\right)}{\lambda_t}\right] - Da_3(x_{r3} - x_{i3}) \tag{13}$$

where $Da_j \equiv \kappa_j \phi L/u$, known as the Damköhler number, was the dimensionless mass transfer coefficient. The magnitude of the Damköhler number represented the rate of mixing of the component between the invaded and resident regions relative to the residence time of fluid in the core. A Damköhler number of zero for all components implies no mixing, and high Damköhler numbers implies rapid mixing.

This model was consistent with the assumption that mixing causes transfer of a component from regions of higher concentration to regions of lower concentration, thus tending to equalize concentrations between the two regions.

The mass transfer coefficients may be functions of the local degree of miscibility, gridcell geometry, invaded fraction ($\theta$), mobility ratio (m), velocity (u), heterogeneity, and water saturation ($S_w$) within the gridcell:

$$\kappa_j = \kappa_j(\text{degree of miscibility, gridblock geometry, } \theta, \text{ m, u, heterogeneity, } S_w) \tag{14}$$

The specific functional dependencies depend on the processes by which the invaded and resident fluids mix. Gardner, J. W., and Ypma, J. G. J., "An Investigation of Phase-Behavior/Macroscopic Bypassing Interaction in $CO_2$ Flooding," *Society of Petroleum Engineering Journal*, pages 508–520, October 1984, disclose the effects of macroscopic bypassing on mixing in multiple-contact miscible displacement processes. The inventors have observed that data presented by Gardner and Ypma imply that mass transfer coefficients should be inversely proportional to the time required to eliminate subgrid fingers by transverse dispersion:

$$\kappa_j = \frac{C_{1j} F_\theta D_{Tj}}{d^2} \tag{15}$$

where d is the transverse width of the gridcell, $D_{Tj}$ is the transverse dispersion coefficient of component j, $F_\theta$ is a parameter accounting for effects of invaded fraction and heterogeneity, and $C_{1j}$ is a constant that may depend on component j.

As a first approximation, the transverse dispersion coefficient includes contributions from molecular diffusion, convective dispersion, and capillary dispersion. The mass transfer coefficient model incorporates these contributions and can be written in dimensionless form as:

$$Da_j = \frac{\kappa_j \phi L}{u} = C_{1j} F_\theta \left[\frac{C_2 D_{oj} \phi L}{d^2 u} + \frac{\alpha_T(d)\phi L}{d^2}\right]\left[1 + C_\gamma\left(\frac{\gamma}{\gamma_{max}}\right)\right] = Da_{Mj}\left[1 + C_\gamma\left(\frac{\gamma}{\gamma_{max}}\right)\right] \tag{16}$$

where $D_{oj}$ is the molecular diffusion coefficient for component j, $\alpha_T(d)$ is transverse dispersivity, $\gamma_{max}$ is the maximum gas-oil interfacial tension for immiscible displacement, $Da_{Mj}$ is the Damköhler number for first-contact miscible displacement, and $C_2$ and $C_\gamma$ are adjustable constants. The terms in the first bracket are the dimensionless rates of mass transfer due to molecular diffusion and convective dispersion, respectively. Molecular diffusion dominates at low velocity and small system width, and convective dispersion dominates at high velocity and large system width ($\alpha_T(d)$ is an increasing function of d). The terms in the second bracket account for capillary dispersion. (Note that when $C_\gamma$ is zero, i.e., the fluids are miscible, $Da_j$ and $Da_{Mj}$ are synonymous.) It was assumed for initial testing purposes that the mass transfer coefficients were unaffected by mobility ratio and water saturation.

In multiple-contact miscible and near-miscible displacements, interfacial tension depended on the location of the gridcell composition within the two-phase region of the phase diagram; the closer the composition was to the critical point, the lower would be interfacial tension. Within the context of the present model, where interfacial tension was a measure of the degree of miscibility between solvent and oil, the interfacial tension in Eq. (16) was the tension that would exist between vapor and liquid if the entire contents of the gridcell was at equilibrium. The following parachor equation was used to calculate interfacial tension:

$$\gamma = \left[\zeta_l \sum_j (P_j x_j) - \zeta_v \sum_j (P_j y_j)\right]^n \tag{17}$$

where $P_j$ is the parachor parameter for component j, $x_j$ and $y_j$ are the mole fractions of component j in the invaded liquid and invaded vapor phases, respectively, $\zeta_l$ and $\zeta_v$ are molar densities of the liquid and vapor and n is an exponent in the range 3.67 to 4.

A key feature of the mechanistic mass transfer model used in this example was that the degree of miscibility between solvent and oil had a significant impact on the rate of mixing between the invaded and resident regions. It has been proposed in the prior art that immiscible dispersion coefficients of fluids in porous media can be about an order of magnitude greater than miscible dispersion coefficients under equivalent experimental conditions. Therefore, mixing should be more rapid under immiscible conditions than under miscible conditions. In the model used in the example, this observation was incorporated by including an interfacial tension dependence in the calculation of the transverse dispersion coefficient. Since the interfacial tension depends on phase behavior through the parachor equation, Eq. (17), the relevant parameter in the context of the model was the interfacial tension constant, $C_\gamma$.

The mass transfer model introduced a number of parameters (e.g., diffusion coefficients, dispersivity, interfacial tension) into the predictive model of this invention that have no counterparts in the Todd-Longstaff mixing model. While these additional parameters increase computational complexity, in contrast to the Todd-Longstaff mixing model, all parameters of the present inventive model have a physical significance that can either be measured or estimated in a relatively unambiguous manner.

Effective Medium Mobility Function

Percolation theory and the effective medium approximation are known techniques for describing critical phenomena, conductance, diffusion and flow in disordered heterogeneous systems (see for example, Kirkpatrick, S., "Classical Transport in Disordered Media: Scaling and Effective-Medium Theories," *Phys. Rev. Lett.,* 27 (1971); Mohanty, K. K., Ottino, J. M. and Davis, H. T., "Reaction and transport in disordered composite media: introduction of percolation concepts," *Chem. Engng. Sci.,* 1982, 37, 905–924; and Sahimi, M., Hughes, B. D., Scriven, L. E. and Davis, H. T., "Stochastic transport in disordered systems," J. Chem. Phys., 1983, 78, 6849–6864). In the context of flow problems in heterogeneous systems, the effective medium approximation represented transport in a random heterogeneous medium by transport in an equivalent (effective) homogeneous medium. The inventors have observed that the agreement between the effective medium approximation and theoretical results is quite good when far away from the percolation threshold.

An effective medium mobility model was generated to evaluate mobilities of fluids in a heterogeneous medium. This was done by assuming that the distribution of solvent and oil within a region of a gridcell could be represented by a random intermingled network of the two fluids. The following analytical expressions for nonaqueous phase mobilities were derived by assuming the network to be isotropic and uncorrelated:

$$\lambda_{ile} = \frac{\theta\lambda_{inv,1}}{\left[1 + \frac{2}{z}\left(\frac{\lambda_{inv}}{\lambda_e} - 1\right)\right]} \tag{18}$$

$$\lambda_{ive} = \frac{\theta\lambda_{inv,v}}{\left[1 + \frac{2}{z}\left(\frac{\lambda_{inv}}{\lambda_e} - 1\right)\right]} \tag{19}$$

$$\lambda_{roe} = \frac{(1-\theta)\lambda_{res,o}}{\left[1 + \frac{2}{z}\left(\frac{\lambda_{res}}{\lambda_e} - 1\right)\right]} \tag{20}$$

$$\lambda_w = \frac{k_{rw}}{\mu_w} \tag{21}$$

where $$\lambda_e = \frac{-b + \sqrt{b^2 + 8(z-2)\lambda_{inv}\lambda_{res}}}{2(z-2)} \tag{22}$$

$$b \equiv \lambda_{inv}[2 - \theta z] + \lambda_{res}[2 - (1-\theta)z] \tag{23}$$

$$\lambda_{inv} = \lambda_{inv,v} + \lambda_{inv,1} \tag{24}$$

$$\lambda_{inv,1} = \frac{k_{r,inv,1}}{\mu_{inv,1}} \tag{25}$$

$$\lambda_{inv,v} = \frac{k_{r,inv,v}}{\mu_{inv,v}} \tag{26}$$

$$\lambda_{res} = \frac{k_{r,res,o}}{\mu_{res,o}} \tag{27}$$

The coordination number, z, is a measure of the "branchiness" of the intermingled fluid networks. Increasing z leads to more segregation of oil and solvent, so that solvent breakthrough is hastened and oil production is delayed. The relative permeabilities were evaluated using the saturation of the fluid within its region. The effective medium mobility model provided approximate analytical expressions for phase mobilities that take into account the relevant properties (invaded fraction, heterogeneity, mobility ratio) in a physically sound manner. Results presented below show that the effective medium mobility model accurately captured the recovery profiles in miscible displacements.

Phase Behavior Function

A simplified pseudo-ternary phase behavior model was used in the examples of this invention for the one-dimensional simulator. In this model, the compositions of mixtures of solvent and oil were characterized in terms of three pseudocomponents: $CO_2$, a light oil component, and a heavy oil component. The two-phase envelope in this phase model was described by a quadratic equation, the constants of which were determined by the compositions for the plait point and the two termini of the envelope at the boundaries. While only approximately representing a real system, this phase model successfully simulated phase behaviors corresponding to differing degrees of miscibility such as first-contact miscible (FCM), multiple-contact miscible (MCM) and near-miscible (NM).

Parameters defining the two-phase envelope used in Examples 1–3 are summarized in Table 1. The parameters in Table 1 for the MCM case defined a pseudo-ternary phase description of the $CO_2$-Means crude system at 2000 psia (13,790 kPa) and 100° F. (37.78° C.). The parameters in Table 1 for the FCM and NM cases defined a pseudo-ternary phase description that might be obtained at 100° F. (37.78° C.) and pressures higher and lower than 2000 psia (13,790 kPa), respectively. The resident oil composition was predominantly heavy, corresponding to a heavy oil fraction of 0.8434 and a light oil fraction of 0.1566.

TABLE 1

| Parameter | | Value |
|---|---|---|
| $V_{1G}$ | | 0.99 |
| $V_{2G}$ $(1-V_{1G})$ | | 0.01 |
| $V_{3G}$ | | 0 |
| $V_{1L}$ | | 0.19197 |
| $V_{2L}$ $(1-V_{2G})$ | | 0.80803 |
| $V_{3L}$ | | 0 |
| $V_{3P}$ | FCM | 0.00 |
| | MCM | 0.09 |
| | NM | 0.36 |
| $V_{2P}$ | FCM | 0.6372 |
| | MCM | 0.5472 |
| | NM | 0.3072 |
| $V_{1P}$ | | 0.3628 |

Referring to Table 1, the subscripts 1, 2 and 3 denote solvent, the heavy oil and light oil, respectively. $V_{1G}$ and $V_{1L}$ represent the termini of a two-phase envelope. $V_{1G\ and\ V1L}$ represent the solvent volume fractions in gas and liquid phases respectively for the solvent-heavy end mixture. $V_{1P}$ and $V_{3P}$ represent the solvent and light end volume fractions at the plait point.

Parameters defining the two-phase envelope used in Example 4 (discussed in more detail below) are summarized in Table 2. Parameters used in Example 4 defined a pseudo-ternary phase description of the $CO_2$-Wasson crude system at 2000 psia (13,790 kpa) and 100° F. (37.78° C.). The data were obtained from Gardner, J. W., Orr, F. M., and Patel, P. D., "The Effect of Phase Behavior on $CO_2$ Flood Displacement Efficiency," *Journal of petroleum Technology*, November 1981, pages 2067–2081. The crude oil composition corresponded to aheavy oil volume fraction of 0.72 and a light oil volume fraction of 0.28.

TABLE 2

| Parameter | Value |
|---|---|
| $V_{1G}$ | 0.97 |
| $V_{2G}$ | 0.03 |
| $V_{3G}$ | 0 |
| $V_{1L}$ | 0.23 |
| $V_{2L}$ | 0.77 |
| $V_{3L}$ | 0 |
| $V_{3P}$ | 0.17 |
| $V_{2P}$ | 0.48 |
| $V_{1P}$ | 0.35 |

Simulation Results

The input data used in the four example simulations assumed oil-brine relative permeability and capillary pressure data characteristic of San Andres carbonate rock. Core properties were length=1 ft (0.3048 m), porosity=0.19%, and permeability=160 md (0.1579 $\mu m^2$).

EXAMPLE 1

Figure 5A:
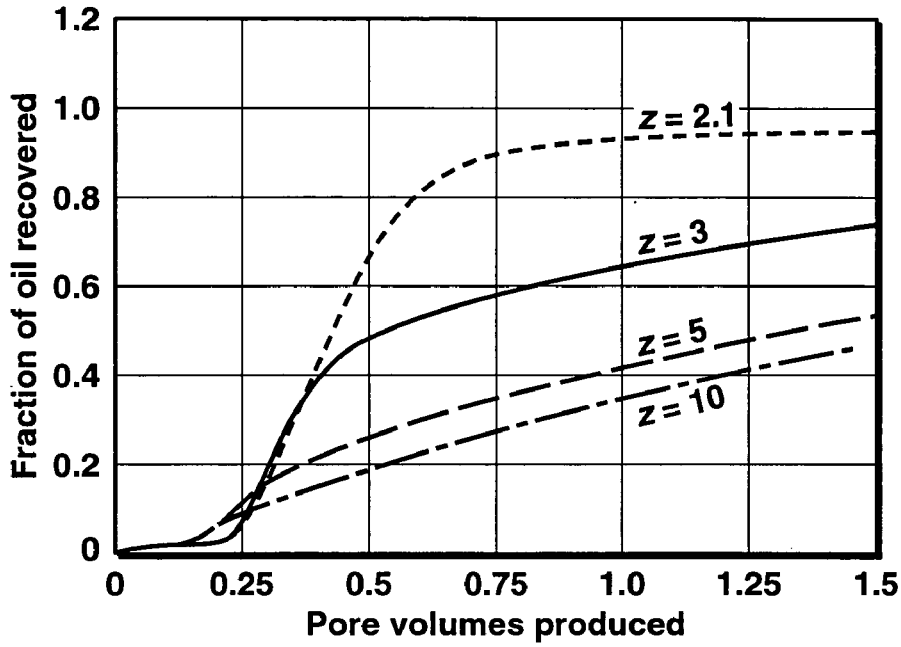
FIG. 5A illustrates the effect of coordination number, z, on total oil recovery for a multiple-contact miscible flood simulated using the method of this invention.
Figure 5B:
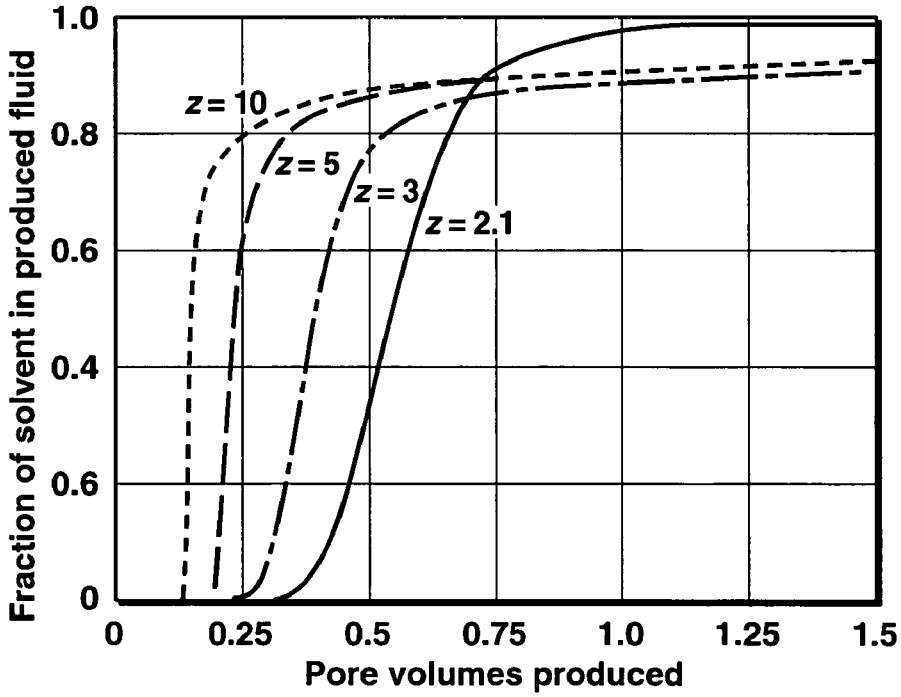
FIG. 5B illustrates the effect of coordination number, z, on solvent breakthrough for a multiple-contact miscible flood simulated using the method of this invention.

The coordination number, z, in the effective medium approximation to the percolation theory denotes the "branchiness" or connectivity of the network. In the context of this invention, z represented finger structure in a gridcell and incorporates the effects of properties such as oil/solvent mobility ratio, reservoir heterogeneity, and rock type. In a general way, z may be analogized to the mixing parameter ω in the Todd-Longstaff mixing model. FIG. 5A shows that increasing z results in reduced oil recovery and FIG. 5B shows that increasing z results in earlier solvent breakthrough. Both the oil recovery and solvent breakthrough curves are sensitive to the value of z. In particular, varying z between two and five reduces oil recovery at 1.5 pore volumes produced from 93% to 52% and reduces the point at which the produced fluid reaches a concentration of 50% solvent from 0.55 to 0.24 pore volumes produced. The MCM phase behavior description in Table 1 was used in this example and the Damköhler numbers were assumed to be $Da_1=0$, $Da_{2=0.1}$, and $Da_{3=0.1}$. The simulation of this example started at a waterflood residual oil saturation of 0.35 and used 25 gridcells in the one-dimensional model.

An increase in the value of z in effective medium model produced an effect similar to a decrease in the value of the mixing parameter ω in the Todd-Longstaff mixing model; both resulted in increased bypassing of oil (lower recovery) and earlier solvent breakthrough. The coordination number z can be assigned values greater than or equal to two in the practice of the method of this invention. z=2 represents flow of oil and solvent in series and characterizes a piston-like displacement with no fingering or channeling. $z\rightarrow\infty$ represents flow of oil and solvent in parallel and characterizes a displacement with extensive fingering or channeling. Based on these results, z can be expected to be important parameter in matching solvent breakthrough and oil production history.

EXAMPLE 2

The Damköhler numbers represent the rate of mixing of components between invaded and resident regions. Results shown in FIGS. 6A through D demonstrate that this invention successfully reproduces the correct limiting behaviors. The MCM phase behavior description in Table 1 was used in this example and the Damköhler numbers were assumed to be $Da_1=0$ for the solvent component and $Da_2=Da_3$ for the oil components. The simulation of this example started at a waterflood residual oil saturation of 0.35 and used 25 gridcells in the one-dimensional model.

Figure 6A:
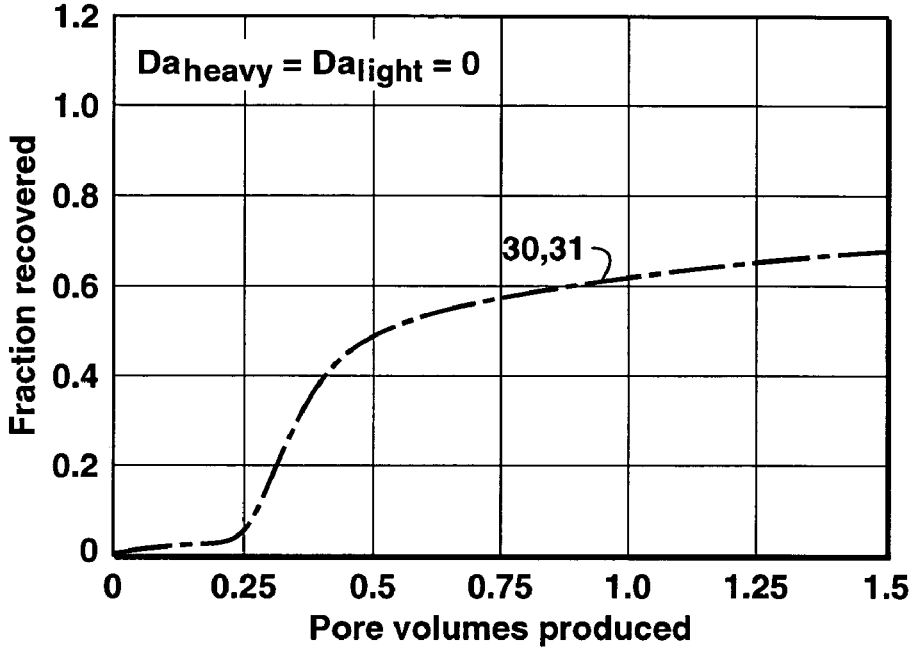
FIGS. 6A–D illustrate the effect of oil Damköhler numbers on heavy and light oil recovery curves for a multiple-contact miscible flood simulated using the method of this invention.

FIG. 6A shows that when there is no mixing (oil Damköhler numbers=0), the model correctly predicts that there is pure displacement of the oil with no exchange of components between regions. In FIG. 6A, curve 30 is the fraction of light oil component recovered and curve 31 (which has exactly the same shape as curve 30) is the fraction of heavy oil component recovered. The light and heavy component recovery curves 30 and 31 are identical, which indicates that the composition of the oil did not change.

When there is rapid mixing (oil Damköhler numbers greater than about 5), the two regions quickly attain nearly identical composition. Therefore, the results of the simulation shown in FIG. 6D are effectively identical to those of a conventional single-region model. In FIG. 6D, curve 60 is the fraction of light oil component recovered and curve 61 is the fraction of heavy oil component recovered. The results shown in FIG. 6D also indicate that as the Damköhler number increases in a MCM recovery process, there is increasing fractionation of the light oil component into the gas phase. Consequently, the light component was preferentially recovered as the invading (high-mobility) solvent swept it out and left behind residual oil enriched in the heavy component.

Figure 6B:
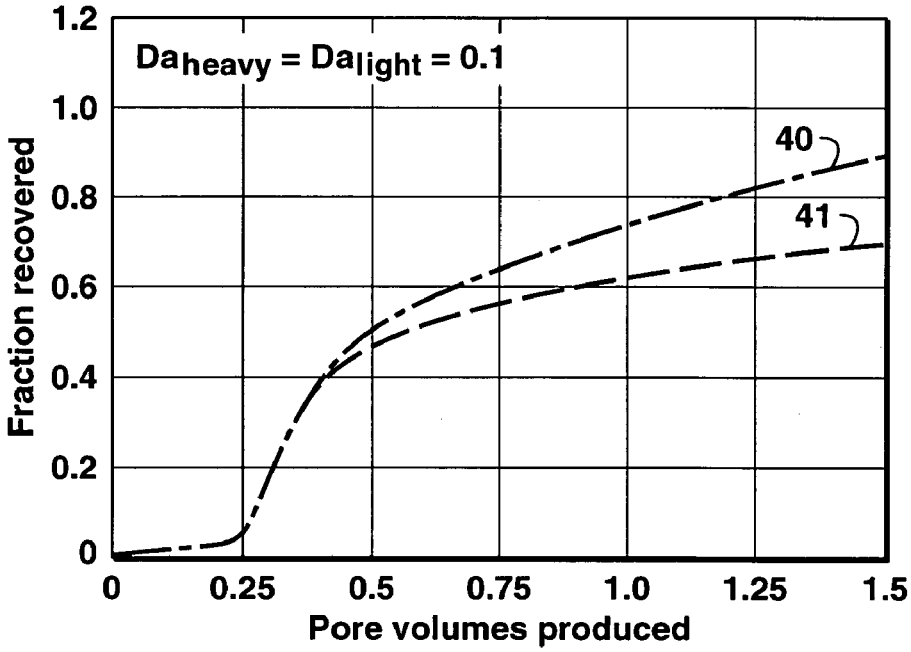
Figure 6C:
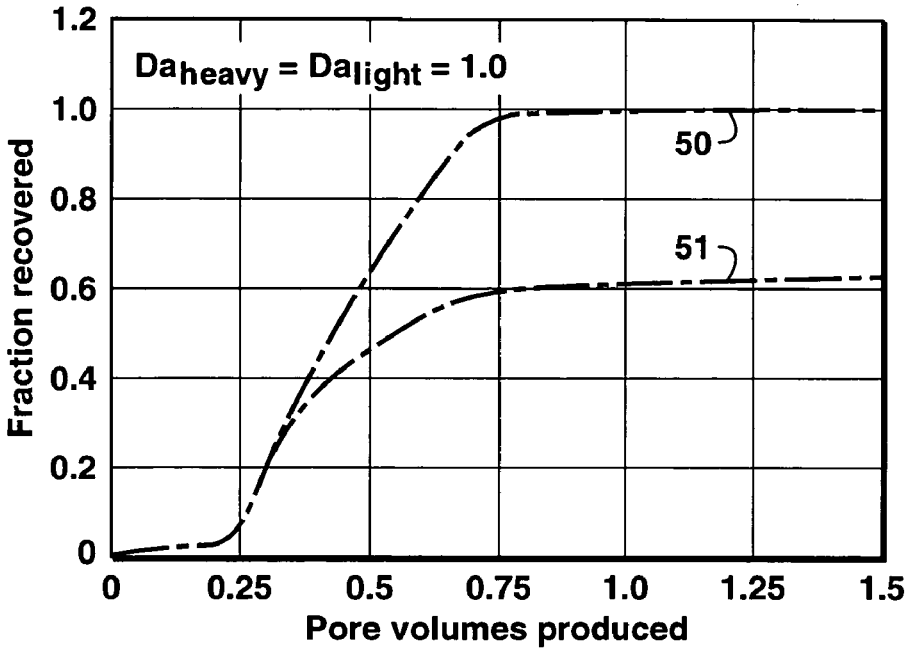
Figure 6D:
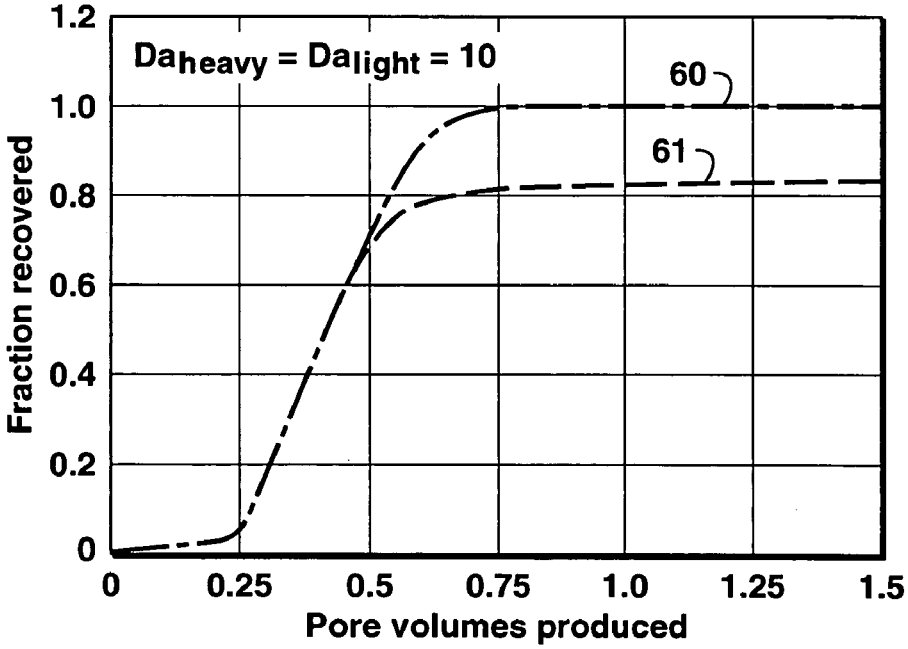

FIGS. 6B and 6C show results for intermediate rates of mixing. In FIG. 6B, curve 40 is the fraction of light oil component recovered and curve 41 is the fraction of heavy oil component recovered. In FIG. 6C, curve 50 is the fraction of light oil component recovered and curve 51 is the fraction of heavy oil component recovered. These figures show that the amount and composition of the oil recovered depends strongly on the Damköhler numbers. Thus, the timing of each component's recovery could be matched by adjusting the Damköhler numbers. Small changes in oil recovery and matching the produced oil and gas compositions could be accomplished through variation of the Damköhler numbers.

EXAMPLE 3

Figure 7:
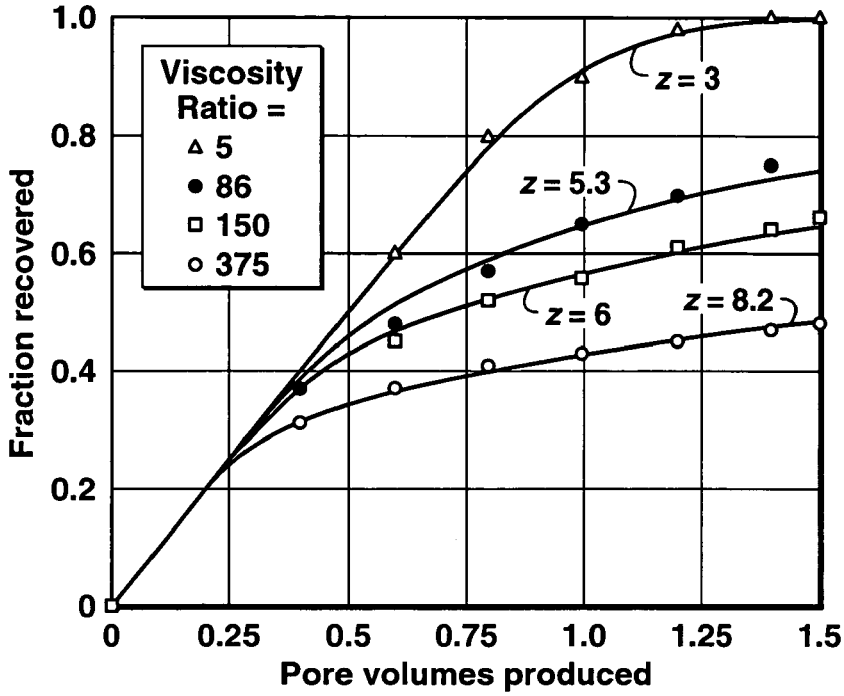
FIG. 7 graphically compares published first-contact miscible flood recovery data and best-fits obtained using the method of this invention.

FIG. 7 shows experimental data presented in a paper by Blackwell, R. J., Rayne, J. R., and Terry, W. M., "Factors Influencing the Efficiency of Miscible Displacement," *Petroleum Transactions, AIME* (1959) 216, 1–8 (referred to hereinafter as "Blackwell et al.") for a first-contact miscible flood at different values of initial oil/solvent viscosity ratio. The experimental data, which appear as points in FIG. 7, were obtained using homogeneous sand packs and fluids of equal density (to minimize gravity segregation). Experiments were conducted at viscosity ratios of 5, 86, 150 and 375. No water was present in the experiments.

Also plotted in FIG. 7 are lines that correspond to oil recoveries obtained from simulations using the method of this invention in which the initial oil/solvent viscosity ratio was set at the experimental value, and the coordination number was adjusted to obtain the best possible fit with the experimental data. The Damköhler number was estimated to be on the order of $10^{-4}$ (based on $D_T$=0.0045 $ft^2$/day (4.2 $cm^2$/day), ϕ=0.4, L=6 ft (1.83 m), d=2 ft (0.61 m), and u=40 ft/day (12.2 m/day)) and was therefore assumed to be effectively zero. There is thus only one adjustable parameter used in the simulation—the coordination number, z. Twenty-five gridcells were used in the one-dimensional model.

FIG. 7 shows excellent agreement between the experimental data of Blackwell et al. and results generated using the method of this invention. In particular, the method of this invention successfully predicted the leveling-off of the oil recovery after initial breakthrough. Moreover, the agreement with the data points for the adverse viscosity ratio displacements was exceptionally good. Since the system employed by Blackwell et al. was first contact miscible and dispersion was negligible, neither phase behavior nor mass transfer played a role in the change in simulated recoveries. The agreement with experiment in this instance is therefore a validation only of the effective medium model of this invention.

Figure 8:
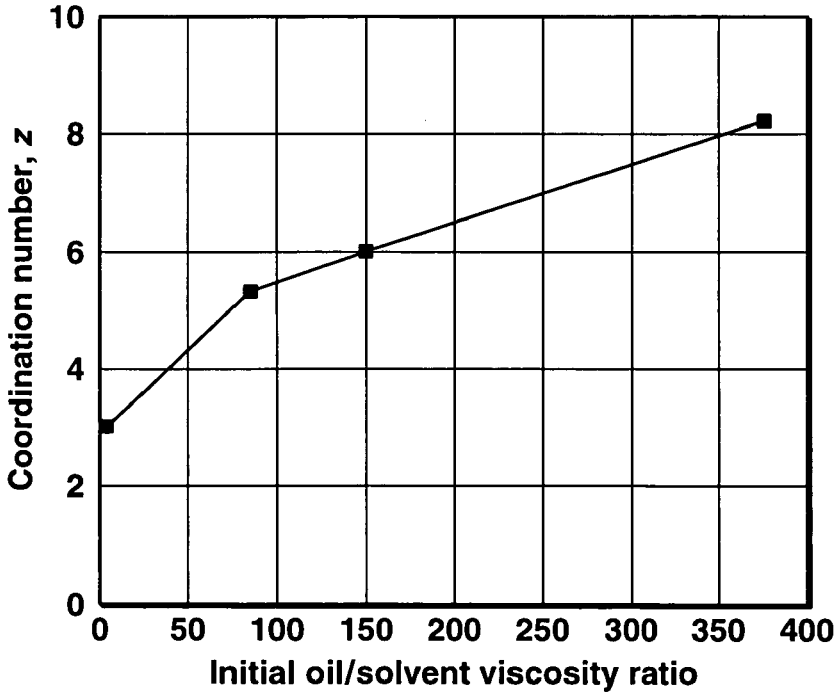
FIG. 8 illustrates coordination numbers obtained by fitting the model used in the method of this invention and published data as a function of oil/solvent viscosity ratio.

While the procedure adopted above may be equated with history matching field data, for the method of this invention to have predictive capability, it would be necessary to be able to predict the value of z a priori. The choice of z would be influenced by the mobility ratio, the reservoir heterogeneity and rock type. FIG. 8 shows a plot of the z values that were used to obtain the fits with experimental data in FIG. 7 as a function of oil/solvent viscosity ratio. As illustrated in FIG. 8, z shows a monotonic variation with viscosity ratio.

The results presented in Examples 1 and 3 indicate that the coordination number, z, is a key parameter in the practice of this invention since it can be used in matching solvent breakthrough and oil production history. Example 2 indicates that fine tuning of oil recovery as well as matching the produced oil and gas compositions can be accomplished through the mass transfer model.

Using the coordination number, z, and the Damköhler numbers as adjustable parameters, and the appropriate phase model for the system under study, the predictive model of this invention could be used to match the essential features (including oil recovery, injected fluid breakthrough, and produced fluid compositions) of any gas injection process.

Example 3 indicates that the effective medium mobility model used in the method of this invention can be used to describe the fingering and bypassing that is prevalent in miscible displacement processes.

EXAMPLE 4

Example 4 is presented to demonstrate the utility of the phase behavior and mass transfer models. Experimental data presented in papers by Gardner, J. W., Orr, F. M., and Patel, P. D., "The Effect of Phase Behavior on $CO_2$ Flood Displacement Efficiency," *Journal of Petroleum Technology*, pages 2067–2081, November 1981 (referred to hereinafter as "*Gardner et al*") and Gardner, J. W., and Ypma, J. G. J., "An Investigation of Phase-Behavior/Macroscopic Bypassing Interaction in $CO_2$ Flooding," *Society of Petroleum Engineers Journal*, pages 508–520, October 1984, disclosed the relationship between phase behavior and displacement efficiency (oil recovery) for miscible gas injection processes. These papers presented results of coreflood experiments on two systems: (i) displacement of Soltrol by $CO_2$ in a first contact miscible (FCM) system, and (ii) displacement of Wasson crude by $CO_2$ in a multiple-contact miscible (MCM) system. Soltrol is a product manufactured by Phillips Petroleum Company and Wasson crude is from the Wasson field in west Texas. The oil/solvent viscosity ratio was 16 for the $CO_2$/Soltrol system and 21 for the $CO_2$/Wasson crude system—close enough so as to make phase behavior the only major distinction between the two systems. Therefore, for all practical purposes, the only reason for any difference in recoveries for the two systems could be attributed to the change in phase behavior and macroscopic bypassing (as a result of the changed phase behavior).

Figure 9:
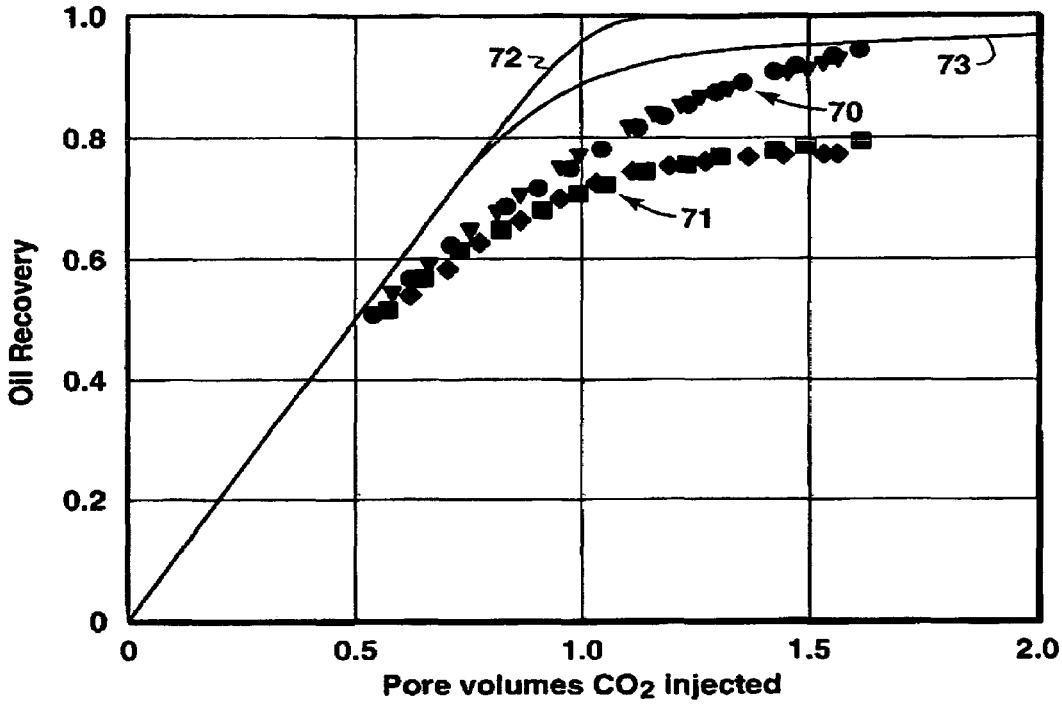
FIG. 9 (Prior Art)
FIG. 9 illustrates published experimental $CO_2$/Soltrol and $CO_2$/Wasson crude coreflood recovery data and simulation predictions using a published single-region model.

FIG. 9 shows the experimental recovery curves obtained for the $CO_2$/Soltrol (curve 70) and $CO_2$/Wasson (curve 71) crude systems. The different sets of symbols denote data obtained in duplicate coreflood experiments under similar conditions. All tests were done in the same Berea core. Ultimate oil recovery efficiency was lower for the $CO_2$/Wasson crude system, as was the rate of recovery.

Viscous fingering was almost entirely responsible for the shape of the FCM $CO_2$/Soltrol recovery curve 70 while both viscous fingering and phase behavior were responsible for the shape of the MCM $CO_2$/Wasson crude recovery curve 71. To test the influence of fingering on recovery, one-dimensional simulations were first run using a conventional single-region model. For the simulations of this example, simulation parameters were set to closely match the $CO_2$/Soltrol and $CO_2$/Wasson crude experimental systems. The $CO_2$ viscosity was set at 0.063 cp (0.000063 Pa/sec) in line with data provided by Gardner et al. Soltrol has a normal boiling point range equivalent to that of $C_{11}$–$C_{14}$, which corresponds to a viscosity of approximately 1.2 cp (0.0012 Pa/sec). However, in order to exactly match the experimental oil/solvent viscosity ratio of 16, the Soltrol viscosity was assumed to be 1.01 cp (0.00101 Pa/sec). Phase viscosities were calculated by the quarter-power blending rule, which is well known to persons of ordinary skill in the art.

Experimental gas/oil relative permeability ratios were used in establishing the relative permeability-saturation relationship in the simulation. The simulations were run with 30 gridcells. The number of gridcells was chosen so as to approximate the level of longitudinal dispersion in the experimental systems. In the case of the $CO_2$/Wasson crude simulation, the phase model was chosen to be the same as the experimental one, shown in Table 2. FIG. 9 shows the recovery curves 72 and 73 obtained from the single-region model simulations along with the experimental data (curves 70 and 71). Curve 72 illustrates simulation results of the $CO_2$/Soltrol system and curve 73 illustrates simulation results of the $CO_2$/Wasson system. It is clear from FIG. 9 that viscous fingering suppresses the rate of recovery of oil. It is also apparent that the single-region model provides an inadequate description (both qualitatively as well as quantitatively) of the oil recovery in the $CO_2$/Soltrol and $CO_2$/Wasson crude systems. However, the single-region simulations are in good agreement with slim tube experiments (*Gardner et al.*) in which the effects of bypassing are suppressed.

To evaluate the ability of the method of this invention to simulate the experimental coreflood data, the method of this invention was first applied to the FCM $CO_2$/Soltrol system. The parameters z, $Da_{solvent}$, $Da_{Mheavy}$ and $Da_{Mlight}$ were adjusted so as to obtain the best possible fit with the experimental data. $Da_{Mheavy}$ was assumed to be equal to $Da_{Mlight}$ for simplicity. The best fit was obtained for the selection z=4.5, $Da_{solvent}$=0, $Da_{Mheavy,\ light}$=0.5. Using the same parameters and assuming $C\gamma$=10, a simulation was carried out using the method of this invention for the $CO_2$/Wasson crude system. All simulation parameters (phase behavior, relative permeability-saturation relationship and dispersion level) were set to match the experimentally determined values (data obtained from *Gardner et al.*). The viscosity of the oil in the simulation was changed to mimic the Wasson crude and an oil/solvent viscosity ratio of 21. These results are plotted in FIG. 10.

Figure 10:
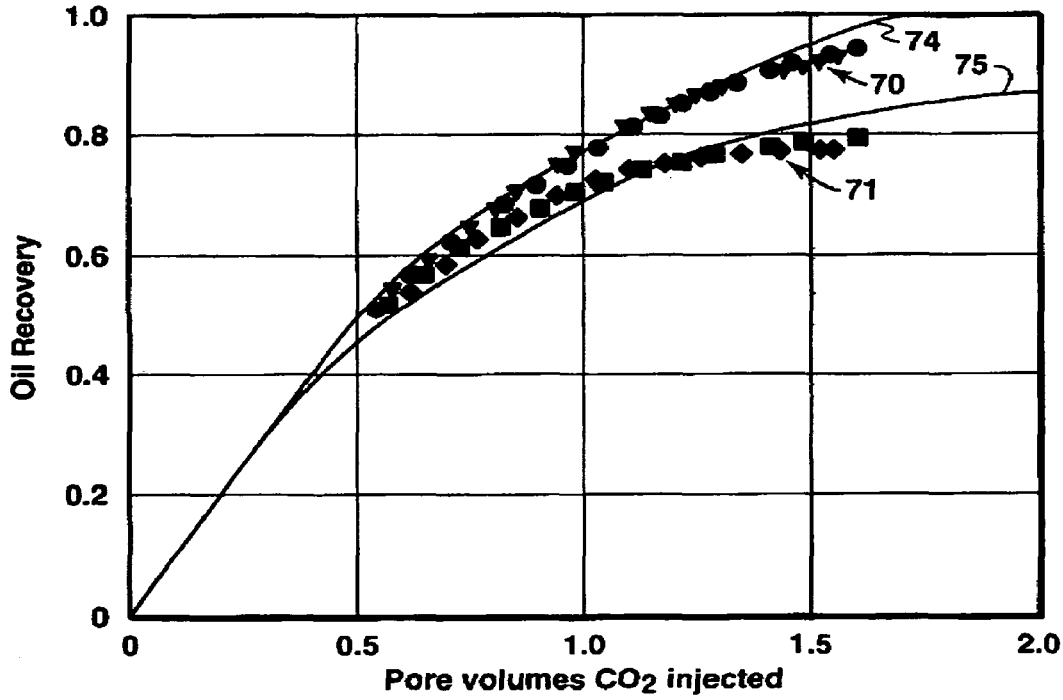
FIG. 10 illustrates published experimental $CO_2$/Soltrol and $CO_2$/Wasson crude coreflood recovery data and simulation predictions using the method of this invention.

In FIG. 10, curves 70 and 71 of FIG. 9 are again shown to compare the simulation results, curve 74, of the $CO_2$/Soltrol system using the two-region model of this invention and simulation results, curve 75 of the $CO_2$/Wasson crude system using the two-region model used in the method of this invention.

The method of this invention did an excellent job of matching the MCM $CO_2$/Wasson using the same parameters that were applied to the FCM $CO_2$/Soltrol crude system. The rationale for keeping z fixed from the $CO_2$/Soltrol simulation is that, since the Soltrol and Wasson crude experiments were conducted on the same cores (same degree of heterogeneity and rock type), and at virtually the same oil/solvent viscosity ratio (same mobility ratio), the value of z must remain essentially unchanged. Mass transfer coefficients increased from the values used for the best fit of the $CO_2$/Soltrol system. Physically, this translates into an increase in mass transfer rates with reduction in miscibility (FCM to MCM)—as miscibility decreases, capillary dispersion increases resulting in higher rates of mass transfer.

In the simulations presented in the foregoing examples, it was assumed that the resident region remained a single-phase liquid. However, the composition of the resident region may enter into the multiphase envelope if solvent components are allowed to transfer into that region, which could be performed by persons skilled in the art. This would necessitate an additional flash calculation for the resident region and the need to specify both vapor and liquid phase permeabilities for that region.

The Partitioned Node Model used in the method of this invention is particularly attractive for use in modeling solvent-flooded reservoirs because all the parameters used in the model have a physical significance that can either be measured or estimated by those skilled in the art.

The coordination number, z, in the effective-medium model can be adjusted to match the timing of injected fluid production. It has been observed that z increases with increasing initial oil/solvent mobility ratio.

The constants, $C_{1j}$, in the mass transfer function can be adjusted to match individual component production histories. Molecular diffusion coefficients, $D_{oj}$, can be estimated with standard correlations known to those skilled in the art. Dispersivity, $\alpha$, and the diffusion constant, $C_2$, will depend on rock properties, and will determine scaling from laboratory to field. In most applications, the interfacial tension parameter, $C_\gamma$, should be a constant, to good approximation.

The effect of gravity on relative mobilities, which was not addressed in foregoing examples, can be also be taken into account by those skilled in the art. For example, it may be expected that within a gridcell, the low-density phase would tend to segregate to the top of the gridcell and would have a higher effective mobility in the upward direction. Anisotropy in permeability was also not considered in the example simulations. In a 3-D simulation, absence of such anisotropy may tend to overestimate flow in the vertical direction. An anisotropic formulation of the effective medium model can be incorporated into the model by those skilled in the art, but this would significantly increase the complexity of the computations.

A still another factor that was not considered in the present examples was the presence of water in the gridcells. In simulating water-alternating-gas (WAG) injection, gas would be injected only into the invaded region and water would only be injected into the resident region. In this way, formation of the invaded region would be triggered only by injection of the high-mobility gas and not by injection of water. Water saturation could also have an effect on the oil/gas mass transfer coefficients—which would typically be incorporated into the model. A transfer function can be developed for water by those skilled in the art, so that water can also partition between the invaded and resident regions.

The principle of the invention and the best mode contemplated for applying that principle have been described. It will be apparent to those skilled in the art that various changes may be made to the embodiments described above without departing from the spirit and scope of this invention as defined in the following claims. It is, therefore, to be understood that this invention is not limited to the specific details shown and described.

Symbols $C_{1j}$ constant used in describing mass transfer coefficient of component j $C_2$ ratio of apparent diffusion coefficient in porous medium to molecular diffusion coefficient $C_\gamma$ interfacial tension (IFT) parameter D width of gridcell $Da_{heavy}$ Damköhler number of heavy oil component $Da_j$ Damköhler number of component j (includes interfacial tension effects)

$Da_{light}$ Damköhler number of light oil component $Da_{Mj}$ Damköhler number of component j for first-contact miscible displacement (excludes interfacial tension effects)

$Da_{solvent}$ Damköhler number of solvent $D_{oj}$ molecular diffusion coefficient for component j $D_{Tj}$ transverse dispersion coefficient of component j FCM First-Contact Miscible $F_\theta$ parameter accounting for effects of invaded fraction and heterogeneity K permeability L core/gridcell length M mobility ratio MCM Multiple-Contact Miscible NM Near-Miscible P pressure $p_c$ capillary pressure $P_j$ parachor parameter for component j Q volumetric injection rate $S_g$, $S_1$ vapor and liquid saturations in the invaded region $S_w$ water saturation T time U velocity $V_{1G}$, $V_{1L}$ pseudo-ternary phase description parameters: solvent volume fractions in gas and liquid phases for the solvent-heavy end mixture $V_{1P}$ pseudo-ternary phase description parameter: solvent volume fraction at the plait point $V_{3P}$ pseudo-ternary phase description parameter: light end volume fraction at the plait point $V_P$ pore volume $W_1$, $W_2$, $W_3$ volume fraction of the solvent, the heavy fraction of the oil and the light fraction of the oil $W_{i1}$, $W_{i2}$, $W_{r3}$ volume fraction of the solvent and heavy fraction of the oil in the invaded region $W_{r1}$, $W_{r2}$, $W_{r3}$ volume fraction of the solvent and heavy fraction of the oil in the resident region X length $x_{ij}$ volume fraction of component j in the nonaqueous portion of the invaded region $x_j$, $y_j$ volume fraction of component j in the liquid and vapor portions of the invaded region $x_{rj}$ volume fraction of component j in the nonaqueous portion of the resident region Z coordination number $\alpha_T$ transverse dispersivity $\beta$ dimensionless permeability, =k/uL $\gamma$ interfacial tension $\gamma_{max}$ maximum gas-oil interfacial tension for immiscible displacement $\xi$ dimensionless length, =x/L $\zeta_l$, $\zeta_v$ molar densities of the liquid and vapor $\phi$ porosity $\kappa$j mass transfer coefficient of component j $\Lambda$j rate of transfer (volume/time) of component j from the resident to the invaded region $\lambda_{ive}$, $\lambda_{ile}$, $\lambda_{roe}$ effective mobilities of the vapor phase in the invaded region, the liquid phase in the invaded region, and the resident fluid.

$\lambda_t$ total effective mobility, $=\lambda_{ive}+\lambda_{ile}+\mu_{roe}+\lambda_w$ $\lambda_w$ mobility of water $\theta$ invaded fraction of gridcell $\tau$ dimensionless time, $=ut/\phi L$

What is claimed is:

1. A computer-implemented method for simulating one or more characteristics of a multi-component, hydrocarbon-bearing formation wherein a displacement fluid comprising at least one component is injected into the formation through at least one well to displace hydrocarbons in the formation, comprising the steps of:

(a) equating the formation in at least one dimension to a multiplicity of gridcells;

(b) dividing at least some of the gridcells into two regions, a first region representing a portion of each gridcell swept by the displacement fluid and a second region representing a portion of each gridcell essentially unswept by the injected fluid, the distribution of components in each region being essentially uniform;

(c) constructing a model representative of fluid properties within each region, fluid flow between gridcells using principles of percolation theory to provide fine-grid adverse mobility displacement behavior through functional dependencies, and principles of component mass transfer rate between regions; and (d) using the model to simulate one or more characteristics of the formation.

2. The method of claim 1 wherein step (d) predicts a property of the formation and fluids contained therein as a function of time.

3. The method of claim 1 wherein the displacement fluid is miscible with hydrocarbons in the formation.

4. The method of claim 1 wherein the displacement fluid is multiple-contact miscible with hydrocarbons present in the formation.

5. The method of claim 1 wherein the displacement fluid is carbon dioxide.

6. The method of claim 1 wherein the displacement fluid comprises hydrocarbon gas.

7. The method of claim 1 wherein model constructed in step (c) is further representative of energy transport between gridcell regions.

8. The method of claim 1 wherein the displacement fluid is steam and the model of step (c) is further representative of energy transport between gridcell regions.

9. The method of claim 1 wherein the gridcells comprises unstructured gridcells.

10. The method of claim 1 wherein the gridcells are three-dimensional.

11. The method of claim 1 wherein the gridcells are two-dimensional.

12. The method of claim 1 wherein the rate of mass transfer of each component is proportional to composition differences and capillary pressure differences between the two regions, and mass transfer mechanisms comprise molecular diffusion, convective dispersion and capillary dispersion.

13. The method of claim 1 wherein the component mass transfer rate between regions is proportional to driving force times resistance.

14. A computer-implemented method for simulating one or more characteristics of a multi-component, hydrocarbon-bearing formation into which a displacement fluid is injected to displace formation hydrocarbons present in the formation, comprising (a) equating at least part of the formation to a multiplicity of gridcells;

(b) dividing each gridcell into two regions, a first region representing a solvent-swept portion of each gridcell and a second region representing a portion of each gridcell essentially unswept by the displacement fluid, the fluid composition within each region being essentially uniform;

(c) constructing a model comprising functions representative of mobility of each phase in each region using principles of percolation theory to provide fine-grid adverse mobility displacement behavior through functional dependencies, functions representative of phase behavior within each region, and functions representative of rate of mass transfer of each component between the regions; and (d) using the model in a simulator to simulate production of the formation and to determine one or more characteristics thereof.

15. The method of claim 14 wherein steps (a) through (d) are repeated for a plurality of time intervals and using the results to predict a property of the hydrocarbon-bearing formation and fluids contained therein as a function of time.

16. A computer-implemented system for determining one or more characteristics of a multi-component, hydrocarbon-bearing formation into which a displacement fluid having at least one component is injected to displace formation hydrocarbons, said system using a multiplicity of gridcells being representative of the formation, comprising (a) a model having each gridcell divided into two regions, a first region representing a portion of each gridcell swept by the displacement fluid and a second region representing a portion of each gridcell essentially unswept by the displacement fluid, distribution of components in each region being essentially uniform and mobility of fluids in each region being determined based on principles of percolation theory to provide fine-grid adverse displacement behavior through functional dependencies; and (b) a simulator, coupled to said model, to simulate the formation to determine one or more characteristics therefrom.

17. The system of claim 16 wherein the model is representative of fluid properties within each region, fluid flow between gridcells, and component mass transfer rate between regions.

18. A method of simulating at least one component of a multicomponent fluid system in a hydrocarbon-bearing formation, whose characterizing features are described by a set of equations, by means of a simulator on a computer, the method comprising the steps of:

(a) providing a model having each gridcell divided into two regions, a first region representing a portion of each gridcell swept by a displacement fluid and a second region representing a portion of each gridcell essentially unswept by the displacement fluid, distribution of components in each region being essentially uniform and mobility of fluids in each region being determined based on principles of percolation theory to provide fine-grid adverse mobility displacement behavior through functional dependencies; and (b) using in the simulator the model thereby simulating changes of a component in the formation.

* * * * *